US010362395B2

(12) United States Patent
Harris

(10) Patent No.: US 10,362,395 B2
(45) Date of Patent: Jul. 23, 2019

(54) PANEL LOUDSPEAKER CONTROLLER AND A PANEL LOUDSPEAKER

(71) Applicant: NVF Tech Ltd., St. Neots, Cambridgeshire (GB)

(72) Inventor: Neil John Harris, Whittlesford (GB)

(73) Assignee: NVF Tech Ltd, London (GB)

( * ) Notice: Subject to any disclaimer, the term of this patent is extended or adjusted under 35 U.S.C. 154(b) by 0 days.

(21) Appl. No.: 15/904,077

(22) Filed: Feb. 23, 2018

(65) Prior Publication Data

US 2018/0249248 A1 Aug. 30, 2018

(30) Foreign Application Priority Data

Feb. 24, 2017 (GB) ..... 1703053.7

(51) Int. Cl.
*H04R 3/12* (2006.01)
*H04R 3/04* (2006.01)
(Continued)

(52) U.S. Cl.
CPC ..... *H04R 3/12* (2013.01); *H04R 3/04* (2013.01); *H04R 7/045* (2013.01); *H04R 17/00* (2013.01);
(Continued)

(58) Field of Classification Search
CPC ..... H04R 1/025; H04R 1/026; H04R 1/2896; H04R 3/04; H04R 3/12; H04R 1/028;
(Continued)

(56) References Cited

U.S. PATENT DOCUMENTS 4,251,688 A * 2/1981 Furner ..... H04S 3/00 381/18
5,357,578 A * 10/1994 Taniishi ..... G10K 15/02 310/324
(Continued)

FOREIGN PATENT DOCUMENTS

EP 1197120 8/2003
EP 1084592 10/2003
(Continued)

OTHER PUBLICATIONS

Search Report issued in British Application No. GB1703053.7, dated Mar. 27, 2017, 3 pages.
(Continued)

*Primary Examiner* — Gerald Gauthier
(74) *Attorney, Agent, or Firm* — Fish & Richardson P.C.

(57) ABSTRACT

A panel loudspeaker controller for controlling a panel loudspeaker including a plurality of actuators, the panel loudspeaker controller including a plurality of electrical signal inputs, each input being associated with each actuator of the panel loudspeaker to be controlled; a plurality of signal processors, each signal processor being associated with each input and having an output for an electrical signal to control an actuator of the panel loudspeaker, and each signal processor implementing a transfer function from its input to its output based on each actuator of the panel loudspeaker to a desired acoustic receiver; and a signal processor controller associated with all of the plurality of signal processors, wherein the signal processor controller is preconfigured to improve phase alignment between the signals as an ensemble output at the outputs of the signal processors.

19 Claims, 13 Drawing Sheets

(51) Int. Cl.
*H04R 7/04* (2006.01)
*H04R 17/00* (2006.01)
*H04R 29/00* (2006.01)

(52) U.S. Cl.
CPC ..... *H04R 29/002* (2013.01); *H04R 29/001* (2013.01); *H04R 2440/01* (2013.01); *H04R 2499/11* (2013.01); *H04R 2499/15* (2013.01)

(58) Field of Classification Search
CPC . H04R 3/14; A63F 13/285; H04S 7/30; H04S 7/305
USPC ..... 381/59, 152, 190, 332, 333, 354, 399, 381/412, 431, 17, 18, 66, 71.2, 71.7, 77, 381/86, 98, 99, 162, 182, 396, 401, 432; 493/52; 715/766; 73/597; 84/721; 181/163, 167; 318/561; 340/539.14; 455/550.1; 711/106
See application file for complete search history.

(56) References Cited

U.S. PATENT DOCUMENTS 5,414,775 A * 5/1995 Scribner ..... G10K 11/178 381/71.2
5,802,555 A * 9/1998 Shigeeda ..... G06F 1/1616 365/193
6,108,433 A * 8/2000 Norris ..... G10K 9/13 367/140
6,332,029 B1 12/2001 Azima et al.
6,519,347 B1 * 2/2003 Morecroft ..... H04R 7/045 381/152
6,546,106 B2 4/2003 Azime
6,681,018 B1 * 1/2004 Asakura ..... H04S 1/005 381/18
6,689,947 B2 * 2/2004 Ludwig ..... G10H 1/00 84/645
6,795,561 B1 9/2004 Bank
6,934,402 B2 * 8/2005 Croft, III ..... H04R 7/22 381/191
7,142,688 B2 * 11/2006 Croft, III ..... H04R 9/047 381/431
7,174,025 B2 2/2007 Azima et al.
7,639,826 B1 * 12/2009 Azima ..... H04R 7/045 381/152
7,889,876 B2 * 2/2011 Hynd ..... H04R 1/025 381/152
9,351,061 B1 * 5/2016 Wollersheim ..... H04R 5/04
2001/0005421 A1 * 6/2001 Harris ..... H04R 7/045 381/332
2001/0006131 A1 * 7/2001 Bream ..... H04R 7/045 181/167
2001/0022835 A1 9/2001 Matsuo
2002/0141607 A1 * 10/2002 Azima ..... H04R 7/045 381/152
2004/0202338 A1 * 10/2004 Longbotttom ..... H04R 17/00 381/190
2004/0223620 A1 11/2004 Horbach et al.
2005/0157905 A1 * 7/2005 Beer ..... H04R 1/24 381/431
2005/0195985 A1 * 9/2005 Croft, III ..... H04R 17/00 381/77
2005/0279566 A1 * 12/2005 Hooley ..... H04R 17/00 181/163
2006/0013417 A1 * 1/2006 Bailey ..... H04R 7/045 381/152
2006/0023898 A1 * 2/2006 Katz ..... G10H 1/32 381/98
2006/0140439 A1 * 6/2006 Nakagawa ..... H04M 1/0266 381/431
2006/0154790 A1 * 7/2006 Mizunuma ..... B29C 43/222 493/52
2007/0133837 A1 * 6/2007 Suzuki ..... H04R 1/26 381/396
2007/0263886 A1 * 11/2007 Starnes ..... H04R 17/10 381/190
2008/0190206 A1 * 8/2008 Matsumoto ..... B81C 99/005 73/597
2008/0285762 A1 * 11/2008 Iwamoto ..... H04R 5/02 381/17
2009/0129613 A1 * 5/2009 Burton ..... H04R 7/045 381/190
2009/0290732 A1 * 11/2009 Berriman ..... H04R 7/045 381/182
2010/0113087 A1 * 5/2010 Demuynck ..... H04M 1/035 455/550.1
2010/0290643 A1 * 11/2010 Mihelich ..... H04S 7/301 381/99
2012/0008818 A1 * 1/2012 Ohashi ..... H04R 1/028 381/432
2012/0019185 A1 * 1/2012 Guidarelli ..... G03B 15/00 318/561
2012/0063609 A1 * 3/2012 Triki ..... H04M 9/082 381/66
2012/0140945 A1 * 6/2012 Harris ..... H04R 1/403 381/86
2013/0272557 A1 * 10/2013 Ozcan ..... G06F 1/1637 381/333
2013/0301866 A1 * 11/2013 Bank ..... H04R 31/003 381/401
2014/0241558 A1 * 8/2014 Yliaho ..... H04R 5/02 381/333
2014/0334638 A1 * 11/2014 Barksdale ..... H04R 3/12 381/86
2015/0102927 A1 * 4/2015 Johnson ..... G08B 1/08 340/539.14
2015/0268830 A1 * 9/2015 Martynov ..... G09G 3/20 715/766
2016/0111078 A1 * 4/2016 Barath ..... G10K 11/178 381/71.7
2016/0309247 A1 * 10/2016 Vanderkley ..... H04R 1/025
2016/0360313 A1 * 12/2016 Mikalauskas ..... H04R 7/045
2017/0087458 A1 * 3/2017 Nakagawa ..... A63F 13/54
2017/0099558 A1 * 4/2017 Spitznagle ..... G06F 3/0481
2017/0180855 A1 * 6/2017 Lee ..... H04R 3/04
2017/0289661 A1 * 10/2017 Hose ..... H04R 7/045
2018/0249248 A1 * 8/2018 Harris ..... H04R 3/04
2018/0359590 A1 * 12/2018 Bocko ..... H04R 1/2811
2019/0007772 A1 * 1/2019 Anderson ..... H04R 3/14

FOREIGN PATENT DOCUMENTS

EP 0847661 11/2004
EP 1068770 4/2005
EP 1959714 8/2008
WO WO2004/103025 11/2004

OTHER PUBLICATIONS

International Search Report and Written Opinion issued in International Application No. PCT/GB2018/050460, dated May 4, 2018, 15 pages.

* cited by examiner

PANEL LOUDSPEAKER CONTROLLER AND A PANEL LOUDSPEAKER

CROSS-REFERENCE TO RELATED APPLICATION

This application is based upon and claims the benefit of priority of the prior United Kingdom Patent Application No. 1703053.7, filed on Feb. 24, 2017, the entire contents of which is incorporated herein by reference.

FIELD

The present disclosure relates to a panel loudspeaker controller and a panel loudspeaker, such as resonant panel form loudspeaker.

BACKGROUND

Conventional loudspeakers use a piston movement at the centre of a diaphragm to cause air to vibrate to produce sound waves. The outer rim of the diaphragm is supported by a frame and the driven centre of the diaphragm is supported by a damper. The diaphragm is usually cone-shape to provide stiffness in its direction of vibration.

In contrast, in a flat panel, panel form or panel loudspeaker, vibrations are applied to specific points on a flat-panel diaphragm by actuators to generate bending waves in the diaphragm. In this way, multiple point sound sources are provided across the entire diaphragm as bending waves distributed over the diaphragm across a range of frequencies in random phases. Panel loudspeakers or panel form loudspeakers are generally described in U.S. Pat. No. 6,332,029 and European patent application with publication No. EP0847661.

Distributed mode (or DM) loudspeakers (or DMLs) are flat panel loudspeakers in which sound is produced by inducing uniformly distributed vibration modes in the panel. A mode is a predictable standing-wave—bending pattern that is obtained by stimulating the panel with a single spot frequency. It is dependent on the physical constraints of the panel and the frequency. DMLs are available in a variety of forms, including as part of a larger structure with rigid boundaries such as described in U.S. Pat. No. 6,546,106 and European patent application with publication No. EP1068770, or as a display element in an electronic device such as described in U.S. Pat. No. 7,174,025 and European patent application with publication No. EP1084592.

While it is common for a DML to be driven by actuators whose size is small compared with the panel, that is not necessarily the case. U.S. Pat. No. 6,795,561 and European patent application with publication No. EP1197120 described activation by an electrically active planar actuator of size similar to the panel being driven.

There is demand for thin electronic devices with audio capability and many of the existing DML applications are considered too thick for these applications. From a technical perspective, large-area electrically active planar actuators are considered attractive for such applications. However, these large-area patches are unattractive due to high component costs, low efficiency and a poor acoustic response.

Furthermore, for providing audio capability with a display, with the introduction of organic light emitting diode (OLED) displays, small patches can be used behind the display and the small patches are no longer restricted to the localised edge drive of the panels as has been the case with backlit liquid crystal displays (LCDs). As a consequence, a method is sought of using a plurality of small patches or arrays of patches, which are cheap, and do not overly stiffen the substrate.

Each actuator is controlled by an electrical input and a panel loudspeaker controlled by n actuators has n input channels (where n is an integer and n>1). From, for example, Audio Engineering Society Convention Paper 5611 presented at the 112th Convention 10-13 May 2013, Munich, Germany, "Multichannel Inverse Filtering of Multiexciter Distributed Mode Loudspeakers for Wave Field Synthesis" Etienne Corteel, Ulrich Horbach and Renato S. Pellegrini, it is known to attempt to calibrate the response of an n channel panel loudspeaker by individually applying an impulse to each input individually and observing the impulse response from each input individually. This calibration is then used on the fly during use of the panel loudspeaker to control the actuators of the panel loudspeaker. This is computationally expensive.

SUMMARY

The inventors of the present patent application have appreciated that, as well as being computationally expensive, that this known arrangement to control multiple patches or actuators to drive a flat panel loudspeaker is, in practice, not particularly effective because different patches or actuators excite modes with opposing phase to each other thereby cancelling out their contributions. The inventors of the present patent application have appreciated, broadly, that to achieve a practical and efficient flat panel loudspeaker driven by a plurality of patches or actuators, that it is advantageous to intelligently select signals to drive the multiple patches cooperatively or, in other words, so that their contributions do not cancel each other inadvertently. The inventors of the present patent application have appreciated that this can be done by first observing the frequency response of the panel loudspeaker to inputs applied to a plurality of actuators of the panel loudspeaker simultaneously and then preconfiguring a controller to control the panel loudspeaker to take into account this frequency response. The preconfiguration may be very simple, such as, a filter, for example, a low pass filter and/or an all-pass filter. In this way, there are low computation requirements of a panel loudspeaker controller, in use, and embodiments of aspects of the present disclosure provide good audio quality across a wide frequency range when a flat panel loudspeaker is driven by a plurality of patches or actuators.

The invention in its various aspects is defined in the independent claims below to which reference should now be made. Advantageous features are set forth in the dependent claims.

Broadly, embodiments relate to panel form loudspeakers, and more particularly to resonant panel form loudspeakers either alone or integrated with another object and typically providing some other function, such as a structural function.

Arrangements are described in more detail below and take the form of a panel loudspeaker controller that is for controlling a panel loudspeaker comprising a plurality of actuators. The panel loudspeaker controller comprises a plurality of electrical signal inputs, a plurality of signal processors, and a signal processor controller. Each input of the plurality of electrical signal inputs is associated with each actuator of the panel loudspeaker to be controlled. Each signal processor of the plurality of signal processors is associated with each input and has an output for an electrical signal to control an actuator of the panel loudspeaker. Each signal processor implements a transfer function from its input to its output based on each actuator of the panel loudspeaker to a desired acoustic receiver. The signal processor controller is associated with all of the plurality of signal processors. The signal processor controller is preconfigured to improve phase alignment between the signals as an ensemble output at the outputs of the signal processors.

A panel loudspeaker may be provided including the panel loudspeaker controller.

Further arrangements are described in more detail below to preconfigure the signal processor controller. They take the form of an electronic device configured to configure a signal processor controller of a panel loudspeaker comprising a plurality of actuators. The electronic device is configured as follows. Electrical signals are provided into a plurality of electrical signal inputs of the electrical device. Each input is associated with each actuator of the panel loudspeaker to be controlled. A response of the panel loudspeaker to the electrical inputs as an ensemble is measured. The response is used to configure the signal processor controller, associated with all of a plurality of signal processors, to improve phase alignment, in use, between signals output at the outputs of the plurality of signal processors as an ensemble. Each signal processor is associated with each input and has an output for an electrical signal to control an actuator of the panel loudspeaker. Each signal processor implements a transfer function from its input to its output based on each actuator of the panel loudspeaker to a desired acoustic receiver, such as a microphone or a user's ear.

These arrangements provide better or more accurate audio control from a panel loudspeaker. These arrangements are computationally inexpensive.

In one aspect, there is provided a panel loudspeaker controller for controlling a panel loudspeaker comprising a plurality of actuators, the panel loudspeaker controller comprising: a plurality of electrical signal inputs, each input being associated with each actuator of the panel loudspeaker to be controlled; a plurality of signal processors, each signal processor being associated with each input and having an output for an electrical signal to control an actuator of the panel loudspeaker, and each signal processor implementing a transfer function from its input to its output based on each actuator of the panel loudspeaker to a desired acoustic receiver; and a signal processor controller associated with all of the plurality of signal processors, wherein the signal processor controller is preconfigured to improve phase alignment between the signals as an ensemble output at the outputs of the signal processors.

The signal processor controller may comprise a filter in order to be preconfigured to improve phase alignment between the signals as an ensemble output at the outputs of the signal processors. The filter may comprise a low pass filter and/or an all-pass filter. The low pass filter may pass signals with a frequency lower than a cut-off frequency of 500 Hz. Each signal processor may comprise a digital signal processor. The signal processor controller may comprise a digital signal processor in order to be preconfigured to improve phase alignment between the signals as an ensemble output at the outputs of the signal processors. Signal processing may be applied by the signal processor controller to the electrical signal inputs to achieve a maximum or near maximum total ensemble output at the outputs at all frequencies. Signal processing may be applied by the signal processor controller to the electrical signal inputs to achieve a minimum or near minimum acoustic pressure at least one predetermined spatial location. The predetermined spatial location may be separate from a location or locations of the maximum or near maximum total ensemble output. The signal processor controller may comprise an equaliser in order to be preconfigured to improve phase alignment between the signals as an ensemble output at the outputs of the signal processors wherein the equaliser equalises the input signals. The equaliser provides a single, global equalisation to the net output of the ensemble. The plurality of actuators may comprise at least one piezoelectric actuator, such as a piezoelectric patch and/or at least one coil and magnet-type actuator. The plurality of actuators may comprise an array of actuators. The plurality of actuators may comprise distributed mode actuators (DMAs). The acoustic receiver may comprise an ear of a user or a microphone.

A panel loudspeaker comprising a panel loudspeaker controller as described above may be provided.

An electronic device, such as computer, for example, a tablet computer or laptop computer, or a display, such as a liquid crystal display, may be provided comprising the panel loudspeaker as described above.

In another aspect, there is provided a panel loudspeaker controlling method for controlling a panel loudspeaker comprising a plurality of actuators, the panel loudspeaker controlling method comprising: inputting a plurality of electrical signals at a plurality of electrical signal inputs, each input being associated with each actuator of the panel loudspeaker to be controlled; a plurality of signal processors, each signal processor being associated with each input and having an output for an electrical signal to control an actuator of the panel loudspeaker, and each signal processor implementing a transfer function from its input to its output based on each actuator of the panel loudspeaker to a desired acoustic receiver; and a signal processor controller associated with all of the plurality of signal processors, the signal processor controller improving phase alignment between the signals as an ensemble output at the outputs of the signal processors based on a preconfiguration.

In another aspect, there is provided an electronic device configured to configure a signal processor controller of a panel loudspeaker comprising a plurality of actuators, the electronic device being configured to: input electrical signals into a plurality of electrical signal inputs, each input being associated with each actuator of the panel loudspeaker to be controlled; measure a response of the panel loudspeaker to the electrical inputs as an ensemble; and use the response to configure a signal processor controller, associated with all of a plurality of signal processors, to improve phase alignment, in use, between signals output at the outputs of the plurality of signal processors as an ensemble, wherein each signal processor is associated with each input and has an output for an electrical signal to control an actuator of the panel loudspeaker, and each signal processor implements a transfer function from its input to its output based on each actuator of the panel loudspeaker to a desired acoustic receiver.

The input electrical signals, actuators, panel loudspeaker and response may be implemented virtually. The input electrical signals may take the form of an impulse and the response may take the form of an impulse response. The electronic device may be configured to use the response to configure the signal processor controller by assessing differences between transfer functions of the signal processors.

In another aspect, there is provided a method of configuring a signal processor controller of a panel loudspeaker comprising a plurality of actuators, the method comprising: inputting electrical signals into a plurality of electrical signal inputs, each input being associated with each actuator of the panel loudspeaker to be controlled; measuring a response of the panel loudspeaker to the electrical inputs as an ensemble;

and using the response to configure a signal processor controller, associated with all of a plurality of signal processors, to improve phase alignment, in use, between signals output at the outputs of the plurality of signal processors as an ensemble, wherein each signal processor is associated with each input and has an output for an electrical signal to control an actuator of the panel loudspeaker, and each signal processor implements a transfer function from its input to its output based on each actuator of the panel loudspeaker to a desired acoustic receiver.

The input electrical signals may take the form of an impulse and the response may take the form of an impulse response. Using the response to configure the signal processor controller may comprise assessing differences between transfer functions of the signal processors.

According to another aspect, there is provided an electronic device configured to configure a signal processor controller of a panel loudspeaker comprising a plurality of actuators by using a response of the panel loudspeaker to electrical inputs, each associated with each actuator of the panel loudspeaker, as an ensemble, wherein the signal processor controller is associated with all of a plurality of signal processors and is configured to improve phase alignment, in use, between signals output at the outputs of the plurality of signal processors as an ensemble, wherein each signal processor is associated with each input and has an output for an electrical signal to control an actuator of the panel loudspeaker, and each signal processor implements a transfer function from its input to its output based on each actuator of the panel loudspeaker to a desired acoustic receiver.

A computer program may be provided for carrying out the method described above. A non-transitory computer readable medium comprising instructions may be provided for carrying out the method described above. The non-transitory computer readable medium may be a CD-ROM, DVD-ROM, a hard disk drive or solid state memory such as a USB (universal serial bus) memory stick.

BRIEF DESCRIPTION OF THE DRAWINGS

Embodiments will be described in more detail, by way of example, with reference to the accompanying drawings, in which:

(FIG. 20A is for a relatively small patch and FIG. 20B is for a relatively large patch).

DETAILED DESCRIPTION

An example panel loudspeaker controller 100 for controlling a panel loudspeaker 101 will now be described with reference to FIGS. 1 and 2. The panel loudspeaker controller of FIG. 1 is for controlling n (where n>1) actuators for exciting a panel of a panel loudspeaker.

Figure 1:
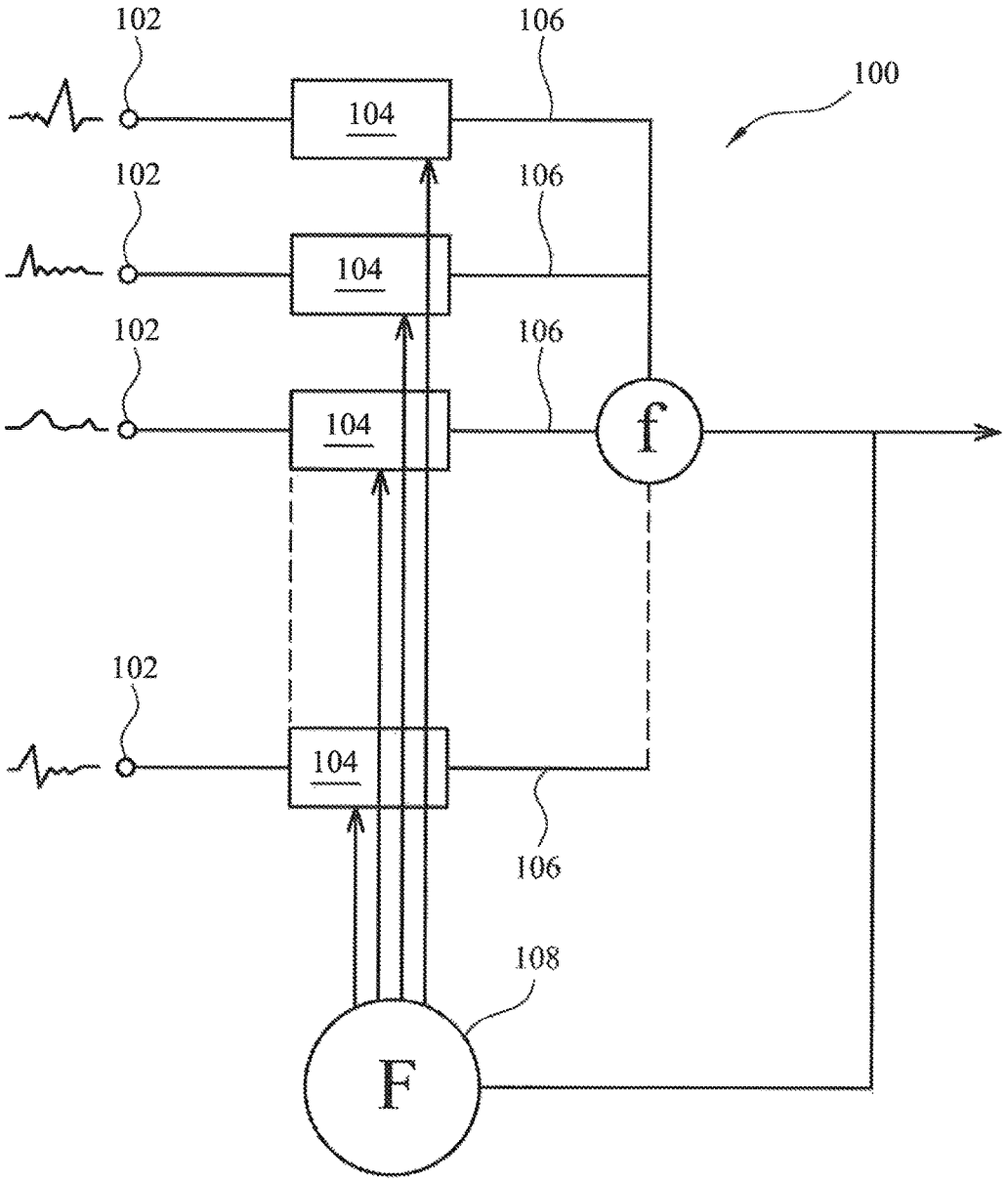
FIG. 1 is a schematic diagram illustrating a panel loudspeaker controller according to certain embodiments.

The panel loudspeaker controller 100 of FIG. 1 has a plurality of electrical signal inputs 102. It is a single or unitary device with n input channels. Each input is associated with each actuator of the n actuators of the panel loudspeaker to be controlled. The controller has n signal processors 104. Each signal processor is associated with each input. Each signal processor has an output 106 for an electrical signal to control an actuator of the panel loudspeaker. Each signal processor implements a transfer function from its input to its output based on each actuator of the panel loudspeaker to a desired acoustic receiver such as an ear or ears of a person expected to listen to audio from the panel loudspeaker or a microphone spaced from the panel loudspeaker. A signal processor controller 108 associated with all of the plurality of signal processors is also provided. The signal processor controller is preconfigured to improve phase alignment between the signals altogether or as an ensemble output at the outputs of the signal processors. The preconfiguration is discussed in detail further below.

Figure 2:
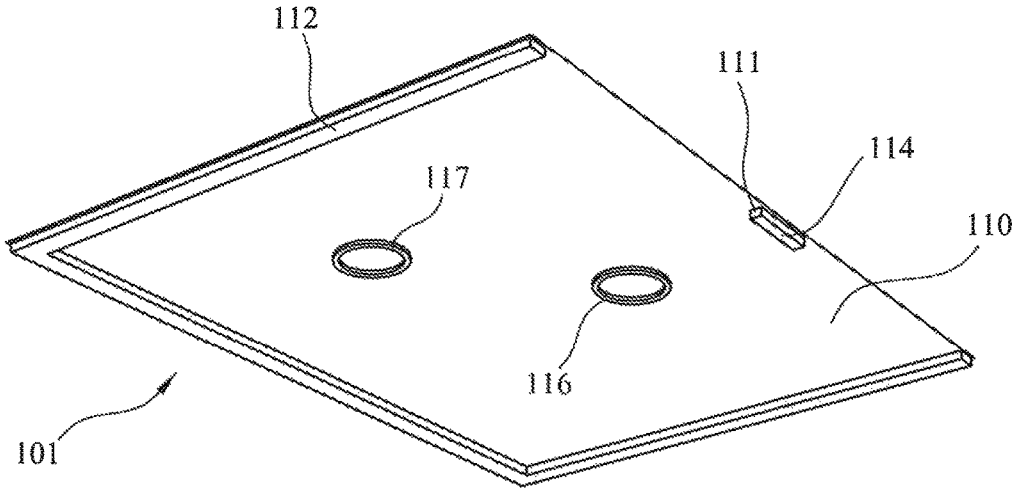
FIG. 2 is a schematic diagram illustrating a panel loudspeaker according to certain embodiments.

FIG. 2 illustrates an example panel loudspeaker 101 controlled by the panel loudspeaker controller 100 of FIG. 1. The panel loudspeaker has a flat radiating panel 110 of, in this example, dimensions of 150 mm×100 mm. The panel includes plurality of different material layers, the details of which are not directly pertinent to the principle of operation. FIG. 2 is a conceptual or schematic drawing of half of the panel loudspeaker. The other half is an exact mirror image in the YZ plane 111, and is suppressed for clarity.

The panel 110 is attached to the rest of a device, such as a housing of an LCD television (not shown) via a mixture of continuous 112 and localised 114 boundary terminations. The former seals the edges of the panel or plate. The latter provides a local anchor point in the middle.

In this example, two identical actuators 116, 117 of the coil and magnet-type are used on each half of the panel 110 (only the coil coupler rings are shown in FIG. 2 for clarity). Placement of the actuators is strongly predetermined by industrial design constraints such as positioning of other components of the LCD television and, in particular, its backlight. The placement of the actuators may be chosen following guidance from, for example, U.S. Pat. No. 6,332,029 or 6,546,106.

Figure 3:
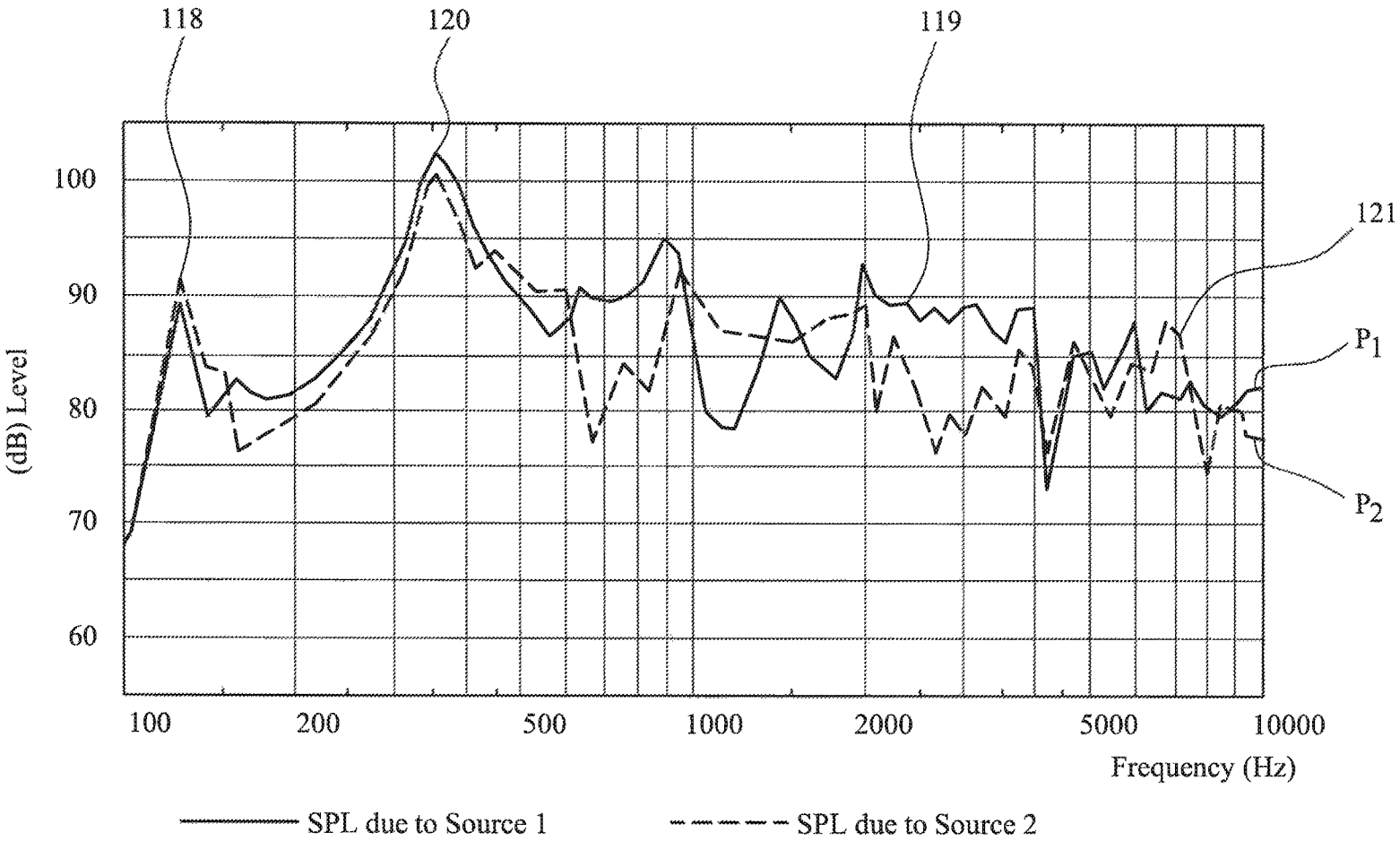
FIG. 3 is a graph of a simulated sound pressure level response against frequency of the two sources of the panel loudspeaker of FIG. 2.

FIG. 3 illustrates simulated sound pressure levels (SPLs) (in dB) against input frequency from the panel loudspeaker 101 of FIG. 2 (the frequency response for actuator 1 or source 1, 116 is shown by a solid line 119 and the frequency response for actuator 2 or source 2, 117 is shown by a dashed line 121). The features of particular note in these responses are the peaks 118 and 120 at around 150 Hz and 350 Hz respectively, the precise frequencies being dependent on the components used. The former peak is due to resonance in the actuators, and the latter is due to the main panel mode.

As demonstrated with reference to FIG. 3, in this example, source 1 (actuator 116) generally produces a higher pressure response. For reasons of stereo separation use of source 2 (actuator 117) would be preferred at higher frequencies, but use of both is needed at lower frequencies in order to improve the frequency response.

Combination Strategies

Figure 4:
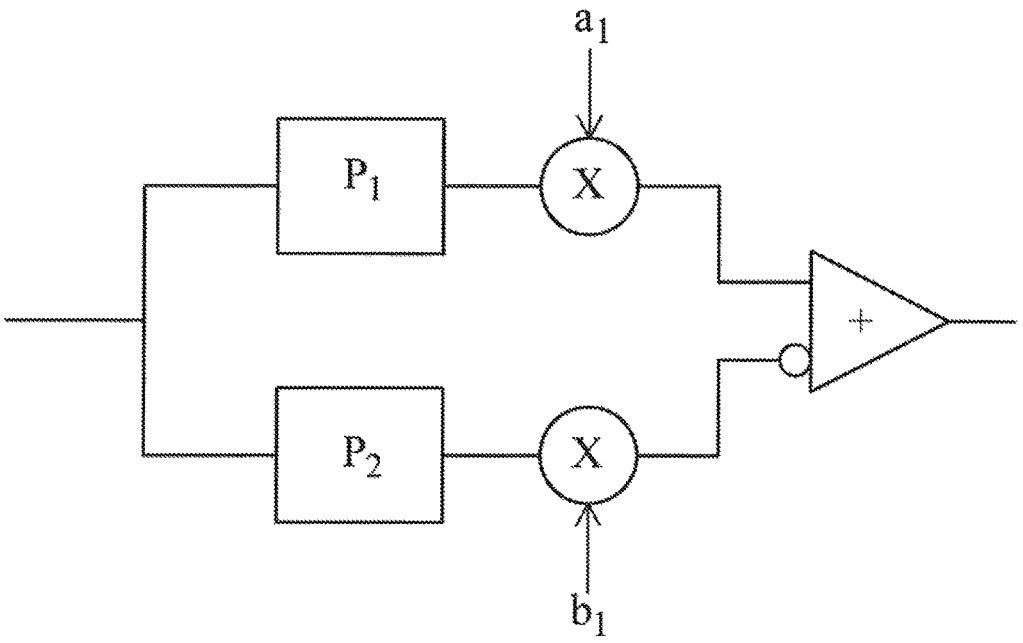
FIG. 4 is a schematic diagram illustrating the panel loudspeaker of FIG. 2.

FIG. 4 is a schematic diagram of the two actuator system of FIG. 2. P1 is a transfer function of actuator 1 and P2 is a transfer function of actuator 2. a and b are input signals to actuator 1 and actuator 2 respectively.

In this example, a common input signal is fed to the two actuators, actuator 1 and actuator 2.

There is a transfer function from the input of each actuator to a target, T, at which we wish to control the signal level. These (frequency dependent) transfer functions are the transfer functions P1 and P2.

We wish to apply (frequency dependent) gains to the two channels; gain 'a' to channel 1 and gain '−b' to channel 2. The total signal arriving at T is therefore given by:

$$T=a.P1-b.P2$$

All the variables may be complex, that is having amplitude and phase or, equivalently, real and imaginary parts.

The total energy input to the actuators is:

$$E_{in}=|a|^2+|b|^2=a.a^*+b.b^*$$

where a* is the complex conjugate of a and b* is the complex conjugate of b (generally an * next to a variable indicates a complex conjugate of that variable).

The total energy arriving at T is given by:

$$|T|^2=|a.P1-b.P2|^2=(a.P1-b.P2).(a^*.P1^*-b^*.P2^*)$$

We are interested in the stationary points of $|T|^2$, which we may find using basic calculus.

$d|T|^2/da^*=(a.P1-b.P2).P1^*$, and $d|T|^2/db^*=(a.P1-b.P2).(-P2^*)$, simultaneously.

There are two principal solution sets for this pair of equations, namely:

$(a.P1-b.P2)=0$, or $a=P2$, $b=P1$, which gives us the local minimum output energy.

$a=P1^*$, $b=-P2^*$, which gives us the local maximum output energy.

The values of a and b may be normalised by placing limitations on the input energy.

If we write the simultaneous equations in matrix form, we get (the over-bar indicates complex conjugation):

$$M\cdot v=\begin{pmatrix}\overline{P1}\cdot P1 & -\overline{P1}\cdot P2\\ \overline{P2}\cdot P1 & -\overline{P2}\cdot P2\end{pmatrix}\begin{pmatrix}a\\ b\end{pmatrix}=\begin{pmatrix}0\\ 0\end{pmatrix}$$

The two eigenvectors of M correspond to the two solutions, with their corresponding eigenvalues giving the total energy.

The same principles may be extended to any number of actuator channels and also to multiple targets.

The maximum response possible from combined unit input power for two actuators is given by the square root of the sum of squares. In other words, maximise $|a\cdot P1-b\cdot P2|^2$ subject to $|a^2|+|b^2|=1$.

A solution is that:

$$a=\frac{\overline{P1}}{\sqrt{|P1^2|+|P2^2|}},\ b=-\frac{\overline{P2}}{\sqrt{|P1^2|+|P2^2|}}$$

(where the over-bar indicates complex conjugation

A solution would be to add the response pressures, but in order to preserve the power constraint, this is divided by the square root of 2.

$$\text{This gives the solution (a naïve solution) } a=b=\frac{1}{\sqrt{2}}$$

Figure 5:
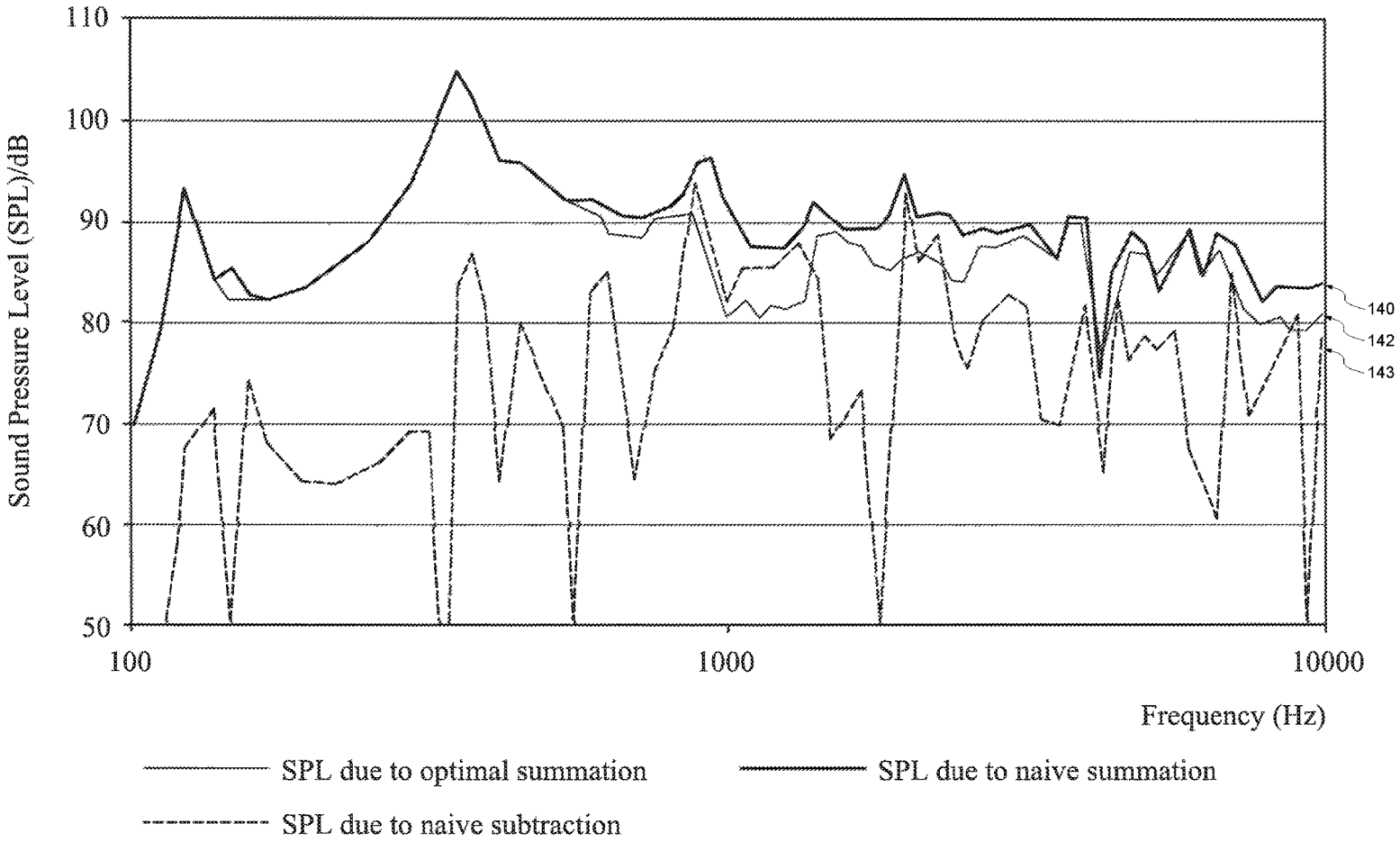
FIG. 5 is a graph of a simulated sound pressure level response of the two sources of the panel loudspeaker of FIG. 2 combined using a naïve summation and a summation using a panel loud speaker controller according to certain embodiments.

FIG. 5 illustrates a comparison between a naïve solution and also a solution demonstrating an example of the present disclosure. FIG. 5 shows sound pressure levels (SPLs) against frequency for a naïve summation (shown by solid line 140), naïve subtraction (shown by dotted line 143) and for an optimal summation (shown by a solid line 142) provide by an example panel loudspeaker controller of the present disclosure. Referring to FIG. 5, we see that this naïve summation solution works quite well at frequencies up to about 600 Hz, but not so well between 600 Hz and 4 kHz. This is explained with reference to FIGS. 6 and 7.

Figure 6:
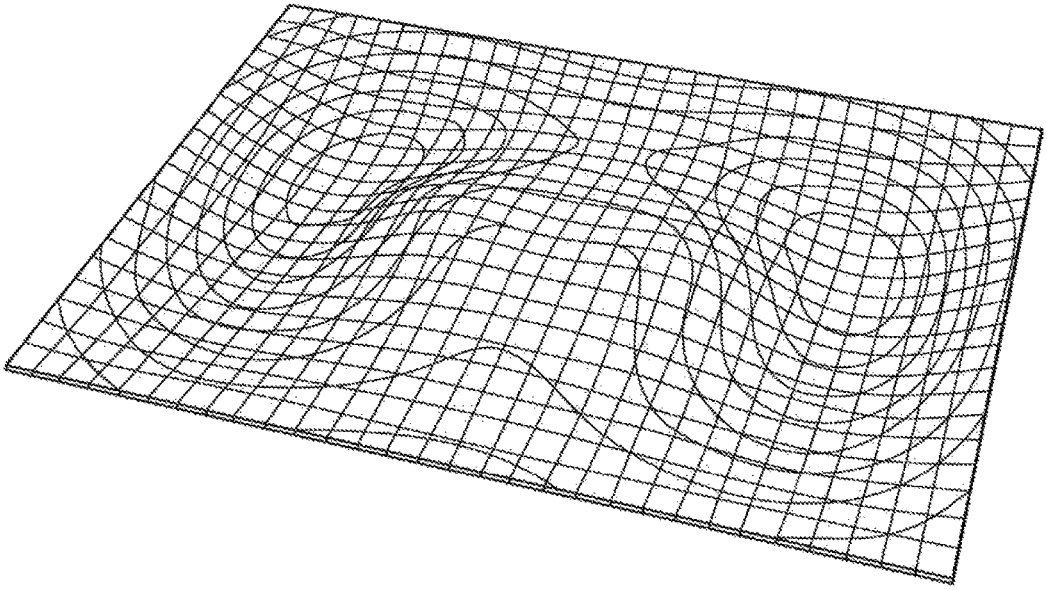
FIG. 6 is a plot of surface deformation and pressure distribution at 500 Hz of the panel loudspeaker of FIG. 2.

FIG. 6 illustrates surface deformation and pressure distribution of the panel loudspeaker 101 of FIG. 2 at 500 Hz, including grid lines and contour lines to show the displacement of the panel loudspeaker. Referring to FIG. 6, we see that the whole surface moves with similar polarity at low frequency (500 Hz), hence in-phase inputs sum constructively.

Figure 7:
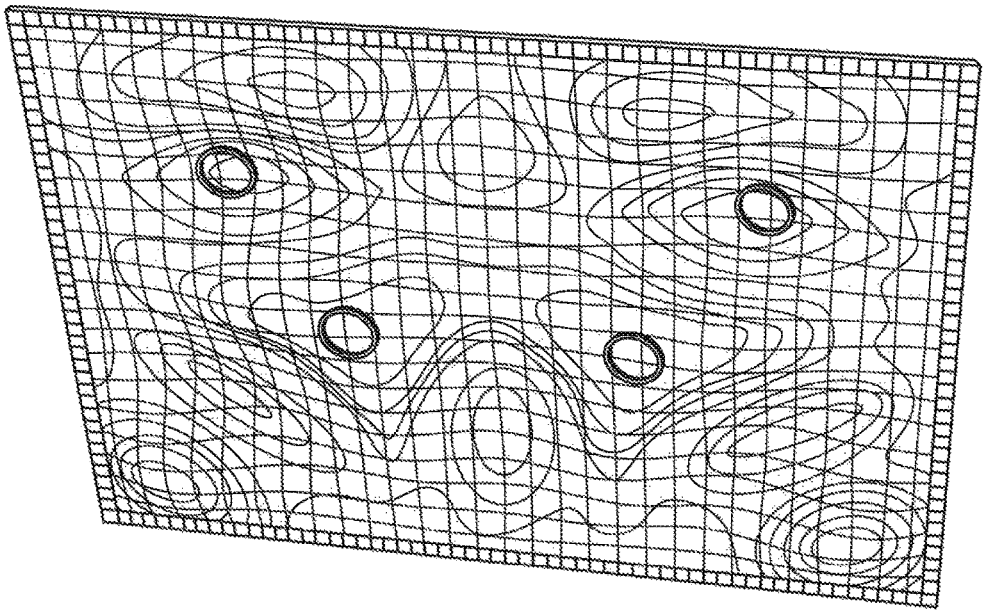
FIG. 7 is a plot of surface deformation and pressure distribution at 2.4 kHz of the panel loudspeaker of FIG. 2.

FIG. 7 illustrates surface deformation and pressure distribution of the panel loudspeaker 101 of FIG. 2 at 2.4 kHz, including grid lines and contour lines to show the displacement of the panel loudspeaker. From FIG. 7, we see that at higher frequencies the surface moves with opposite polarity at the two source points, meaning that in-phase inputs sum 10 destructively.

The inventors of the present application have appreciated that by effectively taking these characteristics into account at the design stage of the panel loudspeaker 101, rather than when it is in use, that they can be addressed computationally economically or inexpensively when the panel loudspeaker is in use. These characteristics may be taken into account by an electronic device, such as general purpose computer such as a desktop computer or laptop computer installed with appropriate software or a computer program. The computer inputs, simulates or virtually provides the input of electrical signals, in the form of an impulse, into a plurality of electrical signal inputs, each input being associated with each actuator of the panel loudspeaker to be controlled. The computer then measures a response, in the form of an impulse response, of the panel loudspeaker to the electrical inputs as an ensemble (real, simulated or virtual). The computer then uses the response to configure a signal processor controller, associated with all of a plurality of signal processors, to improve phase alignment, in use, between signals output at the outputs of the plurality of signal processors as an ensemble. The computer uses the response to configure the signal processor controller by assessing differences between transfer functions of the signal processors. The preconfigured signal processor controller 108 of the panel loudspeaker controller 100 provides for an improvement in phase alignment between signals output from the panel loudspeaker controller in use. A frequency response for such an arrangement is illustrated in FIG. 5 by the solid line 142.

Various arrangements may be provided to preconfigure or provide predetermined characteristics to the panel loudspeaker controller 100 in the example of FIG. 2. These provide phase reversal at particular frequencies of operation of the actuators 116,117 of the panel loudspeaker 101. For example, the signal processor controller 100 may be preconfigured to include one or more of the following.

The signal processor controller 108 of FIG. 1 may be preconfigured to include a filter to filter out one of the inputs 102 to one of the actuators 116, 117 of the panel loudspeaker from about 500 Hz upwards. The signal processor controller may be preconfigured to include all-pass filters to switch the polarity of one actuator or source 116, 117 from, about 600 Hz, and optionally back again at 4 kHz. The signal processor controller may be preconfigured to apply digital signal processing to the inputs signals 102 to the actuators 116, 117 to achieve a near maximum total output at all frequencies. The signal processor controller may be preconfigured to equalise the input signals 102 to the actuators 116, 117 to provide a flatter frequency response.

If different motor systems are provided for the two sources or actuators 116, 117, for example, a larger, more powerful motor with more inductance is provided for the low-frequency source, and a small, lower inductance motor is provided for the high-frequency source, the frequency response is different and therefore the preconfiguration of the signal processor controller 108 is different.

For a larger system, with more input channels and therefore more actuators, the frequencies at which phase begins to matter have been appreciated by the inventors of the present application to be lower, hence the selection of filtering for preconfiguration of the panel loudspeaker controller 100 is more complicated.

The filtering applied for preconfiguration of the signal processor controller 108 of the panel loudspeaker controller 100 may be as follows. These methods calculate the optimum filtering applied to the various input signals 102. They may be implemented by a computer on which appropriate software is installed.

A Simple Maximisation Problem & Solution by "Tan Theta" Approach

Reference is now made to the example of FIG. 1 as well as the schematic representation of a two actuator system illustrated in FIG. 4, that is, a system with two inputs and one output. Let the transfer function from input 1 (e.g., the first input 102 in FIG. 1) to the output be represented by P1, and the transfer function from input 2 (e.g., the second exciter 102 in FIG. 1) to the output 106 be represented by P2. Then, for input signals a and −b, the output signal spectrum T is given by:

$$T=a.P1-b.P2$$

where a, b, P1, P2 and T are all complex functions of frequency.

The problem to be solved is to find the stationary points (points on a curve where the gradient is zero) T for all frequencies. There is no unique solution to the problem, but it is clear from observation that a and b should be related; specifically:

$$b=a.P1/P2, \text{ or } a=b.P2/P1$$

Using these ratios is generally not a good idea, as either P1 or P2 may contain zeros. One simple solution as described above is to set a=P2 and b=P1. The solution may be normalised to unit energy, that is $|a|^2+|b|^2=1$. As P1 and P2 are in general complex quantities, the absolute values are important. Thus, a stationary value of T is given by setting:

$$a=\frac{P2}{\sqrt{|P1|^2+|P2|^2}},\ b=-\frac{P1}{\sqrt{|P1|^2+|P2|^2}}$$

Incidentally, T is maximised to unity by setting $$a=\frac{\overline{P1}}{\sqrt{|P1|^2+|P2|^2}},\ b=-\frac{\overline{P2}}{\sqrt{|P1|^2+|P2|^2}}$$

If P1 or P2 are measured remote from the input, as is generally the case in acoustics, the transfer function includes excess phase in the form of delay. Consequently, these values of a and b may not be the best choice. If we set a=cos(θ) and b=sin(θ) (that is transform from Cartesian to polar coordinates), the problem changes from an under-determined two variable simultaneous equation, into a single equation in the new variable, θ (the other, implied, variable is the radius, given by $r^2=a^2+b^2$, but we want to keep this constant and so set it to unity). With a=cos(θ) and b=sin(θ), then tan(θ)=P1/P2. This solution is described as the "tan theta" solution and produces a and b with much less excess phase. It is clear that $a^2+b^2=1$ due to the trigonometric identity, but as θ is in general complex, $|a|^2+|b|^2\neq1$, so normalisation is required.

In this simple example, the problem is solved by inspection. As this may not be possible in general, it is advantageous to have a systematic method of finding the solution, which is explained below.

Variational Methods

The objective is to determine values of parameters that lead to stationary values to a function (i.e., to find nodal points, lines or pressures). The first step of the process is forming the energy function. For our example, the squared modulus of T may be used, i.e., $E=|T|^2=|a.P1-b.P2|^2$. The stationary values occur at the maximum and the minimum of E.

$$E=(a\cdot P1-b\cdot P2)\cdot\overline{(a\cdot P1-b\cdot P2)}$$

There is a constraint on the values of a and b—they cannot both be zero. This constraint may be expressed using a so called "Lagrange multiplier", λ, to modify the energy equation. λ is a new variable that is introduced to enforce the constraint equation $|a|^2+|b|^2=1$. Thus, (where E is energy);

$$E=(a\cdot P1-b\cdot P2)\cdot\overline{(a\cdot P1-b\cdot P2)}+\lambda\cdot(\bar{a}\cdot a+\bar{b}\cdot b-1)$$

The complex conjugate of each variable may be considered as an independent variable. We differentiate E with respect to each conjugate variable in turn, thus;

$$\frac{\partial E}{\partial \bar{a}}=(a\cdot P1-b\cdot P2)\cdot\overline{P1}+\lambda\cdot a \tag{1}$$

$$\frac{\partial E}{\partial \bar{b}}=-(a\cdot P1-b\cdot P2)\cdot\overline{P2}+\lambda\cdot b \tag{2}$$

At the stationary points, both of these must be zero. It is possible to see straight away that the solutions found in the previous section apply here too. However, continuing to solve the system of equations formally, first the equations are combined to eliminate λ by finding:

$$(1).b-(2).a$$

$$(a\cdot P1-b\cdot P2)\cdot\overline{P1}\cdot b+(a\cdot P1-b\cdot P2)\cdot\overline{P2}\cdot a=0$$

The resulting equation is quadratic in a and b, the two solutions corresponding to the maximum and the minimum values of E. Introducing a=cos(θ) and b=sin(θ)—although strictly speaking this does not satisfy the Lagrange constraint—obtains a quadratic equation in tan(θ).

$$P1\cdot\overline{P2}+(|P1|^2-|P2|^2)\cdot\tan(\theta)-P2\cdot\overline{P1}\cdot\tan(\theta)^2=0$$

Noting that in many cases, $(|P1|^2-|P2|^2)^2+4\cdot P1\cdot\overline{P2}\cdot P2\cdot\overline{P1}=(|P1|^2+|P2|^2)^2$, we arrive at the same answers as before, namely $$\theta=\arctan\left(\frac{P1}{P2}\right)\text{ for the minimum, and}$$

$$\theta=\overline{\arctan\left(-\frac{P2}{P1}\right)}\text{ for the maximum}$$

For completeness, it is noted that this identity might not apply in the general case, where P1 and P2 are sums or integrals of responses. Nevertheless, it is possible to systematically find both stationary values using this variation of the "tan theta" approach. One application is explained in more detail below to illustrate how these solutions may be used in the examples described above.

Application 1: Maximum Acoustic Response

In the case where everything is completely symmetrical, the stationary points are trivial—a and b are set to equal values. When there is asymmetry in the system, this assumption is no longer valid. The problem to solve is to find two sets of input values a and b which give maximum output for audio where desired and minimum output for audio where not desired. This is exactly the problem solved in the "variational methods" section.

P1 and P2, shown in FIG. 3 as dB sound pressure level (SPL), are the acoustic responses at 10 cm, obtained in this case by finite element simulation of the panel form loudspeaker configuration of FIG. 2—they could equally well have been obtained by measurement.

Referring to FIG. 5, the result from using an optimal filter pair (line 142) (max and min, according to the two solutions for θ), is compared with the simple sum (line 140) and difference (line 143) pair in FIG. 5. The summed response is higher than the subtracted response over much of the band, it is not always so. Although, the on-axis response (response spaced from the panel loudspeaker in air) does not tell the whole story, the averaged results over the front hemisphere show similar features.

The solution described above may be applied to extended areas by measuring the target at a number of discrete sampling points. In this case, it is desirable to simultaneously find the stationary points of the outputs by manipulating the inputs. There are now more output signals than input signals, so the result is not exact. This is one of the strengths of the variational method—it can find the best approximation.

$$\sum_i T_i=\sum_i |a\cdot P1_i-b\cdot P2_i|^2=\sum_i (a\cdot P1_i-b\cdot P2_i)\cdot\overline{(a\cdot P1_i-b\cdot P2_i)}$$

$$E=\sum_i (a\cdot P1_i-b\cdot P2_i)\cdot\overline{(a\cdot P1_i-b\cdot P2_i)}+\lambda\cdot(\bar{a}\cdot a+\bar{b}\cdot b-1)$$

$$\frac{\partial E}{\partial \bar{a}}=\sum_i (a\cdot P1_i-b\cdot P2_i)\cdot\overline{P1_i}+\lambda\cdot a$$

$$\frac{\partial E}{\partial \bar{b}}=-\sum_i (a\cdot P1_i-b\cdot P2_i)\cdot\overline{P2_i}+\lambda\cdot b$$

Solving these as before yields $$S12+(S11-S22)\cdot\tan(\theta)-S21\cdot\tan(\theta)^2=0$$

where $$Snm=\sum_i Pn_i\cdot\overline{Pm_i}$$

(for the *Pnth* actuator at the *ith* measurement point)

$$\theta_m=\arctan\left(\frac{S11-S22+\sqrt{(S11-S22)^2+4\cdot S12\cdot S21}}{2\cdot S21}\right),$$

gives the minimum $$\theta_p=\arctan\left(\frac{S11-S22-\sqrt{(S11-S22)^2+4\cdot S12\cdot S21}}{2\cdot S21}\right),$$

gives the maximum

The method extends similarly to integrals, and to more than two inputs.

For example, the error function and the sums may be replaced with integrals;

$$E=\oint\!\!\oint |a\cdot P1(\underline{r})-b\cdot P2(\underline{r})|^2 dA+\lambda\cdot(\bar{a}\cdot a+\bar{b}\cdot b-1)$$

$$Snm=\oint\!\!\oint Pn(\underline{r})\cdot\overline{Pm(\underline{r})}dA$$

Application 2: Dual Region Acoustics

It is possible to simultaneously specify a minimal response at an elected position or spatial location and a non-zero response at another elected position or spatial location. In other words, the signal processor controller of the flat panel loudspeaker controller may apply signal processing may to the electrical signal inputs to achieve a minimum or near minimum acoustic pressure at at least one predetermined location. This is very useful in dual region systems.

Strong Solution.

We have two inputs (for example), to produce one nodal point and an acoustic response at another point. Define transfer functions Pi_j from input i to output j.

Simultaneously solve a.P1_1+b.P2_1=0 and a.P2_1+b.P2_2=g.

$$\begin{pmatrix} P1_1 & P2_1 \\ P1_2 & P2_2 \end{pmatrix}\begin{pmatrix} a \\ b \end{pmatrix} = \begin{pmatrix} 0 \\ g \end{pmatrix}, \begin{pmatrix} a \\ b \end{pmatrix} = \begin{pmatrix} P1_1 & P2_1 \\ P1_2 & P2_2 \end{pmatrix}^{-1}\begin{pmatrix} 0 \\ g \end{pmatrix}$$

$$a = -\frac{P2_1}{P1_1 \cdot P2_2 - P1_2 \cdot P2_1} \cdot g,$$

$$b = \frac{P1_1}{P1_1 \cdot P2_2 - P1_2 \cdot P2_1} \cdot g$$

Provided the denominator is never zero, this pair of transfer functions will produce a nodal response at point 1, and a complex transfer function exactly equal to g at point 2.

Weak Solution

Simultaneously solve |a.P1_1+b.P2_1|$^2$=0 and |a.P2_1+b.P2_2|$^2$=|g|$^2$.

Use the variational methods discussed below to solve the first minimisation for a and b, and the normalise the result to satisfy the second equation.

$$a = r \cdot \cos(\theta),\ b = -r \cdot \sin(\theta),\ \tan(\theta) = -\frac{P1_1}{P1_2}$$

$$r^2 \cdot |(\cos(\theta) \cdot P2_1 - \sin(\theta) \cdot P2_2)|^2 = |g|^2, \text{ hence } r.$$

Provided the denominator is never zero, this pair of transfer functions will produce a nodal response at point 1, and a power transfer function equal to |g|$^2$ at point 2. The resulting output at point 2 will not necessary have the same phase response as g, so the coercion is not as strong.

There are other extensions to the methods described above that are particularly relevant when considering more than two input channels. These extensions are general, and would equally well apply to the two-channel case. Additionally, by using eigenvalue analysis as a tool, we get the best solution, which is not the exact solution, when no exact solution is available.

Relationship Between the Variational Method and the Eigenvalue Problem

When minimising an energy function of the form E, below, we arrive at a set of simultaneous equations;

$$E = \left|\sum_n a_n \cdot P_n\right|^2,\ \frac{\partial E}{\partial \overline{a_n}} = \overline{P_n} \cdot \sum_n a_n \cdot P_n = 0, \text{ for all } n$$

where $P_i$ are the inputs to the system and $a_i$ the constants applied to these inputs, i.e., a and b in the previous two channel system.

We may write this system of equations in matrix form, thus:

$$\underline{\underline{M}} \cdot \underline{v} = 0, \text{ where } \underline{\underline{M}}_{i,j} = \overline{P_i} \cdot P_j, \text{ and where } \underline{v}_i = a_i \tag{1}$$

Note that $M$ is conjugate symmetric, i.e., $\underline{\underline{M}}_{j,i} = \overline{\underline{\underline{M}}_{i,j}}$ We wish to find a non-trivial solution; that is a solution other than the trivial v=0, which although mathematically valid, is not of much use.

As any linear scaling of v is also a solution to the equation, the ai are not uniquely defined. We need an additional equation to constrain the scaling. Another way of viewing things is to say that for an exact solution, the number of input variables must be greater than the number of measurement points. Either way, there is one more equation than free variables, so the determinant of M will be zero.

Consider the matrix eigenvalue problem, where we wish to find a non-trivial solution to the equation:

$\underline{\underline{M}} \cdot \underline{v} - \lambda \cdot \underline{v} = 0$, where λ is an eigenvalue, and the associated $\underline{v}$ is the eigenvector. (2)

As M is conjugate symmetric, all the eigenvalues will be real and non-negative. If λ=0 is a solution to the eigenvalue problem, we have our original equation. So v is the eigenvector for λ=0.

What is particularly powerful about this method, is that even when there is no solution to (1), the solution to (2) with the smallest value of λ is the closest approximate answer. For example, using the problem posed above:

$$\begin{pmatrix} \overline{P1} \cdot P1 & -\overline{P1} \cdot P2 \\ -\overline{P2} \cdot P1 & \overline{P2} \cdot P2 \end{pmatrix} \cdot \begin{pmatrix} a \\ b \end{pmatrix} - \lambda \cdot \begin{pmatrix} a \\ b \end{pmatrix} = 0,$$

has a solution $\lambda = 0,\ b/a = P1/P2$.

The other eigenvalue corresponds to the maximum; λ=|P1|$^2$+|P2|$^2$, b/a=$-\overline{P2}/\overline{P1}$ When using an eigenvalue solver to find the values of $a_i$, the scaling used is essentially arbitrary. It is normal practice to normalise the eigenvector, and doing so will set the amplitudes;

$$\sum_i |a_i|^2 = 1$$

$$\text{For example, } a = \frac{P2}{\sqrt{|P1|^2 + |P2|^2}},\ b = \frac{P1}{\sqrt{|P1|^2 + |P2|^2}}$$

The reference phase, however, is still arbitrary—if v is a normalised solution to the eigen-problem, then so is v.$e^{j\theta}$. What constitutes the best value for θ, and how to find it is the subject of a later section.

The value of the eigenvalue λ is just the energy associated with that choice of eigenvector. The proof follows;

$$E = \left|\sum_n a_n \cdot P_n\right|^2 = \sum_n a_n \cdot P_n \cdot \sum_m \overline{a_m} \cdot \overline{P_m} =$$

-continued $$\sum_m \overline{a_m}\cdot\left(\sum_n \overline{P_m}\cdot P_n\cdot a_n\right)=\sum_m \overline{a_m}\cdot\left(\sum_n M_{mn}\cdot a_n\right)$$

From our eigenvalue equation and normalisation of the eigenvector, we can continue by stating $$E=\sum_m \overline{a_m}\cdot\left(\sum_n M_{mn}\cdot a_n\right)=\sum_m \overline{a_m}\cdot(\lambda\cdot a_m)=\lambda\cdot\sum_m \overline{a_m}\cdot a_m=\lambda$$

Solving the Eigenvalue Problem

In principle, a system of order n has n eigenvalues, which are found by solving an nth order polynomial equation. However, we do not need all the eigenvalues. The smallest eigenvalue is a best solution to the minimisation problem. If the eigenvalue happens to be zero, then it is an exact solution. The largest eigenvalue is a best solution to the maximisation problem.

$$\underline{\underline{M}}\cdot\underline{v}-\lambda\cdot\underline{v}=0,\text{ leads to }|M-\lambda\cdot I|=0,\text{ leads to }\prod_{i=1}^{n}(\lambda-\lambda_i)=0$$

If there is an exact solution to the problem, the determinant will have λ as a factor. For example, $$\left|\begin{pmatrix} a & b \\ \overline{b} & c\end{pmatrix}-\lambda\cdot\begin{pmatrix}1 & 0\\ 0 & 1\end{pmatrix}\right|=\left|\begin{pmatrix} a-\lambda & b \\ \overline{b} & c-\lambda\end{pmatrix}\right|=(a-\lambda)(c-\lambda)-|b|^2=0$$

$$a\cdot c-|b|^2-(a+c)\cdot\lambda+\lambda^2=0$$

If $a.c-|b|^2=0$, then there is an exact solution.

As the number of equations is greater than the number of unknowns, there are more than one possible sets of solutions to v, but they are all equivalent;

$$(a-\lambda)\cdot v_0+b\cdot v_1=0,\ \frac{v_1}{v_0}=\frac{\lambda-a}{b}$$

$$\overline{b}\cdot v_0+(c-\lambda)\cdot v_1=0,\ \frac{v_1}{v_0}=\frac{\overline{b}}{\lambda-c}$$

For example $a=2,\ b=1+1j,\ c=3;\ 6-2-5.\lambda+\lambda^2=0;\ \lambda=1,4$ $(\lambda-2)/(1+1j)=(-1+1j)/2$ or $1-1j$ $(1-1j)/(\lambda-3)=(-1+1j)/2$ or $1-1j$ So the best solution to the pair of equations is given by v1/v0=(−1+1j)/2

Choosing the Best Scaling for the Solution

Mathematically speaking, any solution to the problem of preconfiguring a signal processor controller to improve phase alignment between the signals output from the signal processor controller as an ensemble output at the outputs of the signal processors is as good as any other. However, we are trying to solve an engineering problem. Both the matrix, M, and its eigenvectors, v, are functions of frequency. We wish to use the components of v as transfer functions, so having sudden changes of sign or phase is not preferred.

$\underline{\underline{M}}(\omega)\cdot\underline{v}(\omega)=0$

For the two-variable problem, we used the substitution a=cos(θ) and b=sin(θ), and then solve for tan(θ). This method produces values of a and b with low excess phase. However, using this method quickly becomes unwieldy, as the equations get more and more complicated to form, never mind solve. For example, for 3 variables we have 2 angles and can use the spherical polar mapping to give a=cos(θ). cos(φ), b=cos(θ). sin(φ), c=sin(θ).

Instead, let us use the variational method to determine the best value for θ. We will define best to mean having the smallest total imaginary component.

Now, let $v'=v.e^{j\theta}$, let v=vr+j.vi, and define our error energy as:

$$SSE=\sum_i \mathrm{Im}(v_i')^2=\sum_i \mathrm{Im}((vr_i+j\cdot vi_i)\cdot(\cos(\theta)+j\cdot\sin(\theta)))^2=$$

$$\sum_i (vi_i\cdot\cos(\theta)+vr_i\cdot\sin(\theta))^2$$

Let $$rr=\mathrm{Re}(v)\cdot\mathrm{Re}(v)=\sum vr_i^2,\ \ ii=\mathrm{Im}(v)\cdot\mathrm{Im}(v)=\sum vi_i^2,$$

$$ri=\mathrm{Re}(v)\cdot\mathrm{Im}(v)=\sum vr_i\cdot vi_i$$

Then $$SSE=\cos(\theta)^2.ii+2.\cos(\theta).\sin(\theta).ri+\sin(\theta)^2.rr$$

(For θ=0, SSE=ii, which is our initial cost. We want to reduce this, if possible).

Now differentiate with respect to θ to give our equation $$2.(\cos(\theta)^2-\sin(\theta)^2).ri+2.\cos(\theta).\sin(\theta).(rr-ii)=0$$

Dividing through by $2.\cos(\theta)^2$, we get the following quadratic in tan(θ);

$$ri+\tan(\theta).(rr-ii)-\tan(\theta)^2.ri=0$$

Of the two solutions, the one that gives the minimum of SSE is:

$$\tan(\theta)=\frac{rr-ii-\sqrt{(rr-ii)^2+4\cdot ri^2}}{2\cdot ri}$$

If ri=0, then we have two special cases;

If $ri=0$ and $rr>=ii$, then θ=0.

If $ri=0$ and $rr<ii$, then θ=π/2.

The final step in choosing the best value for v is to make sure that the real part of the first component is positive (any component could be used for this purpose), i.e.

Step 1 $v'=v.e^{j\theta}$

Step 2 if $v'_0<0$, $v'=-v'$

EXAMPLE $$v = \begin{pmatrix} 0.908 - 0.419j \\ 0.770 - 0.638j \\ 0.9999 - 0.01j \\ 0.343 - 0.939j \end{pmatrix},$$

$rr$=2.534, $ii$=1.466, $ri$=−1.204; solving gives θ=0.577

$$v' = \begin{pmatrix} 0.990 + 0.143j \\ 0.993 - 0.115j \\ 0.844 + 0.537j \\ 0.800 - 0.600j \end{pmatrix}$$

$rr'$=3.318, $ii'$=0.682, $ri$=0

Note that minimising ii simultaneously maximises rr and sets ri to zero.

Comparison of Techniques—A Worked Example

Consider a two-input device with two outputs (i.e., the device described above). There will be exact solutions for minimising each output individually, but only an approximate solution to simultaneous minimisation.

Output 1 transfer admittances: $P1_1$=0.472+0.00344$j$, $P2_1$=0.479−0.129$j$

Output 2 transfer admittances: $P1_2$=−0.206−0.195$j$, $P2_2$=0.262+0.000274$j$

Form two error contribution matrices:

$$M1 = \begin{pmatrix} 0.223 & 0.226 - 0.063j \\ 0.226 + 0.063j & 0.246 \end{pmatrix};$$

$|M1| = 0$, i.e., exact solution possible $$M2 = \begin{pmatrix} 0.080 & -0.054 + 0.050j \\ -0.054 - 0.050j & 0.069 \end{pmatrix};$$

$|M2| = 0$, i.e., exact solution possible $$M1 + M2 = \begin{pmatrix} 0.303 & 0.171 - 0.012j \\ 0.171 + 0.012j & 0.315 \end{pmatrix};$$

$|M1 + M2| = 0.066$

We now use the "tan theta" method to solve the three cases.

$$\begin{pmatrix} a \\ b \end{pmatrix}_1 = \begin{pmatrix} 0.718 - 0.093j \\ -0.682 - 0.098j \end{pmatrix},$$

$$\begin{pmatrix} a \\ b \end{pmatrix}_2 = \begin{pmatrix} 0.623 - 0.270j \\ 0.692 + 0.244j \end{pmatrix},$$

$$\begin{pmatrix} a \\ b \end{pmatrix}_{1+2} = \begin{pmatrix} 0.719 - 0.024j \\ -0.694 - 0.025j \end{pmatrix}$$

For the eigenvector method, there are two eigenvector solvers; one solves for all vectors simultaneously, and the other solves for a specific eigenvalue. They give numerically different answers when the vectors are complex (both answers are correct), but after applying the "best" scaling algorithm, both solvers give the same results as those above.

M1: eigenvalues, 0 and 0.469:

Eigenvector before scaling: (−0.698+0.195$j$,0.689−0.0013$j$) or (0.724,−0.664−0.184$j$)

Eigenvector after scaling: (0.718−0.093$j$,−0.682−0.098$j$)

M2: eigenvalues, 0 and 0.149:

Eigenvector before scaling: (−0.5+0.46$j$,0.734−0.0030$j$) or (0.498−0.462$j$,0.724)

Eigenvector after scaling: (0.623−0.270$j$,0.692+0.244$j$)

M1+M2: eigenvalues, 0.137 and 0.480:

Eigenvector before scaling: (−0.717+0.051$j$,0.695−0.0007$j$) or (0.719,−0.693−0.049$j$)

Eigenvector after scaling: (0.719−0.024$j$,−0.694−0.025$j$)

Adding a 3rd Input

Now consider the contributions from a third input channel.

Output 1 transfer admittance: $P3_1$=−0.067−0.180$j$

Output 2 transfer admittance: $P3_2$=0.264+0.0014$j$

Add these contributions to the error matrices:

$$M1 = \begin{pmatrix} 0.223 & 0.226 - 0.063j & -0.032 - 0.085j \\ 0.226 + 0.063j & 0.246 & -0.009 - 0.095j \\ -0.032 + 0.085j & -0.009 + 0.095j & 0.037 \end{pmatrix};$$

$|M1| = 0$ $$M2 = \begin{pmatrix} 0.080 & -0.054 + 0.050j & -0.055 + 0.051j \\ -0.054 - 0.050j & 0.069 & 0.069 - 0.0004j \\ -0.055 - 0.051j & 0.069 + 0.0004j & 0.070 \end{pmatrix};$$

$|M2| = 0$ $$M1 + M2 = \begin{pmatrix} 0.303 & 0.171 - 0.012j & -0.087 - 0.034j \\ 0.171 + 0.012j & 0.315 & 0.061 - 0.095j \\ -0.087 + 0.034j & 0.061 + 0.095j & 0.107 \end{pmatrix};$$

$|M1 + M2| = 0$

Now there is an exact solution to the joint problem, and M1+M2 has a zero eigenvalue.

(Note that M1 and M2 individually have two zero eigenvalues each—in other words they have a degenerate eigenvalue. There are two completely orthogonal solutions to the problem, and any linear sum of these two solutions is also a solution).

M1+M2: eigenvalues are 0, 0.218 and 0.506:

Eigenvector after scaling: (0.434−0.011$j$,−0.418+0.199$j$,0.764+0.115$j$)

As illustrated above, for two inputs, the "tan theta" method is quicker and simpler to implement, however for three or four inputs the "scaled eigenvector" method is easier. Both methods produce the same result. For an exact solution, the number of input variables must be greater than the number of measurement points. By using eigenvalue analysis as a tool for the general problem, we get the best solution when no exact solution is available.

For the general 'm' input, 'n' output minimisation problem there are two principle variations on an algorithm to find the best m inputs. These are referred to as the parallel "all at once" method and the serial "one at a time" method. In general, these may be combined. If m>n, then all routes end up with the same, exact answer (within rounding errors). If m<=n, then there are only approximate answers, and the route taken will affect the final outcome. The serial method is useful if m<=n, and some of the n outputs are more important than others. The important outputs are solved exactly, and those remaining get a best fit solution.

The Parallel, "all at Once" Algorithm

Figure 8:
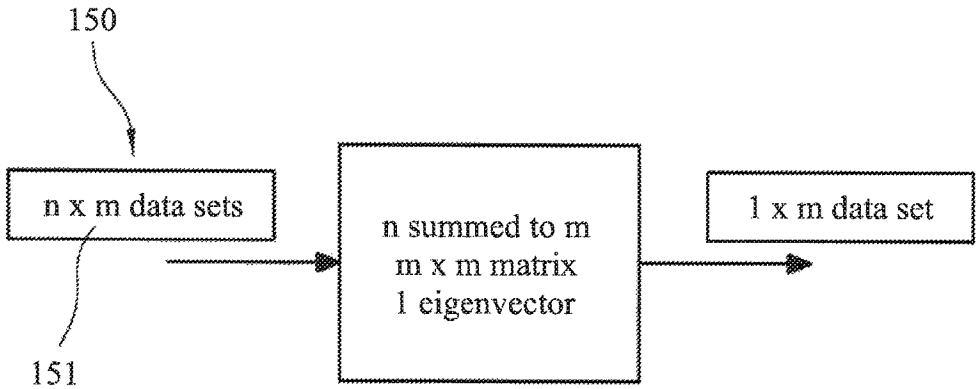
FIG. 8 is a block diagram of a parallel solver of an example of the panel loudspeaker controller of FIG. 1.

FIG. 8 is a block diagram of a parallel solver 150 for n×m data sets 152. One error matrix or data set 154 is formed. The eigenvector corresponding to the lowest eigenvalue is chosen. If m>n, then the eigenvalue will be zero, and the result exact.

The Recursive or Sequential, "One at a Time" Algorithm

Figure 9:
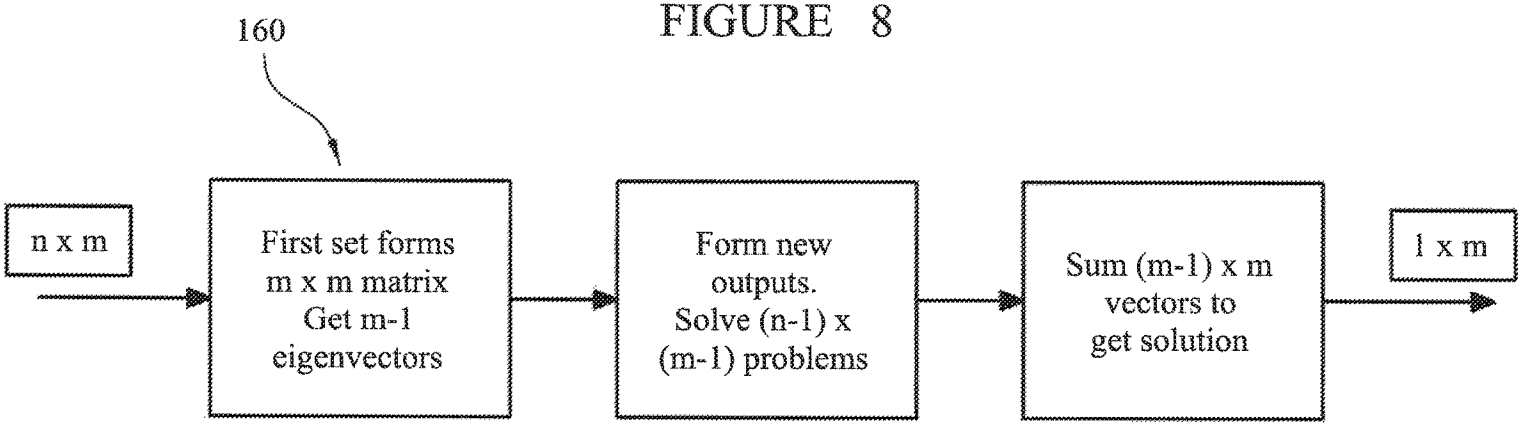
FIG. 9 is a block diagram of a recursive solver of an example of the panel loudspeaker controller of FIG. 1.

FIG. 9 is a block diagram of a recursive solver 160. An error matrix for the most important output is formed, and the eigenvectors corresponding to the (m−1) lowest eigenvalues are formed. These are used as new input vectors, and the process is repeated. The process ends with a 2×2 eigenvalue solution. Backtracking then reassembles the solution to the original problem.

As with all recursive algorithms, this process may be turned into an iterative (or sequential) process. For the first m−2 cycles, all the outputs have exact solutions. For the remaining cycle, the best linear combination of these solutions is found to minimise the remaining errors.

Example 1: m=3, n=2

Output 1 transfer admittances: $P1_1=0.472+0.00344j$

Output 2 transfer admittances: $P1_2=-0.206-0.195j$

Output 1 transfer admittances: $P2_1=0.479-0.129j$

Output 2 transfer admittances: $P2_2=0.262+0.000274j$

Output 1 transfer admittance: $P3_1=-0.067-0.180j$

Output 2 transfer admittance: $P3_2=0.264+0.0014j$

All at Once $$M1+M2=\begin{pmatrix} 0.303 & 0.171-0.012j & -0.087-0.034j \\ 0.171+0.012j & 0.315 & 0.061-0.095j \\ -0.087+0.034j & 0.061+0.095j & 0.107 \end{pmatrix};$$

$$|M1+M2|=0$$

M1+M2: eigenvalues are 0, 0.218 and 0.506:

Eigenvector after scaling: $(0.434-0.011j,-0.418+0.199j,0.764+0.115j)$

One at a Time

Solve output 1, and then output 2. As 3>2 we should get the same answer.

$$M1=\begin{pmatrix} 0.223 & 0.226-0.063j & -0.032-0.085j \\ 0.226+0.063j & 0.246 & -0.009-0.095j \\ -0.032+0.085j & -0.009+0.095j & 0.037 \end{pmatrix};$$

$$|M1|=0$$

M1+M2: eigenvalues are 0, 0 and 0.506:

Eigenvector $V1$: $(0.748,-0.596-0.165j,0.085-0.224j)$

Eigenvector $V2$: $(-0.062+0.026j,0.096+0.350j,0.929)$

New problem; select a and b such that a.V1+b.V2 minimises output 2.

New transfer admittances are;

$pv1=(P1_2\ P2_2\ P3_2).V1=-0.287-0.250j$ $pv2=(P1_2\ P2_2\ P3_2).V1=0.287+0.100j$

We now repeat the process using these two transfer admittances as the outputs.

New error matrix is:

$$M1`=\begin{pmatrix} 0.145 & -0.107+0.043j \\ -0.107-0.043j & 0.093 \end{pmatrix};$$

$|M1`|=0$, i.e., exact solution possible

M1' eigenvalues, 0 and 0.237

Eigenvector after scaling: $(0.608-0.145j,0.772+0.114j)$

Now combine V1 and V2 to get the inputs $(0.608-0.145j)V1+(0.772+0.114)V2=(0.404-0.095j,-0.352+0.268j,0.737-0.042j)$ Normalise and scale the result: $(0.434-0.011j,-0.418+0.199j,0.764+0.115j)$ Notice that this is the same as before, just as it should be.

Example 2: m=3, n>=3

Here we have 1 acoustic pressure output and a number of velocity outputs.

Acoustic scaled error matrix is M1, summed velocity scaled error matrix is M2.

$$M1=\begin{pmatrix} 3.928 & -2.667+2.473j & -2.674+2.506j \\ -2.667-2.473j & 3.367 & 3.393-0.018j \\ -2.674-2.506j & 3.393+0.018j & 3.418 \end{pmatrix};$$

$$|M1|=0$$

$$M2=\begin{pmatrix} 1.023 & 0.602-0.112j & -0.528+0.409j \\ 0.602+0.112j & 0.977 & -1.144+0.205j \\ -0.528-0.409j & -1.144-0.205j & 5.473 \end{pmatrix};$$

$$|M2|=2.510$$

All at Once

All n output error matrices are summed and the eigenvector corresponding to the lowest eigenvalue is found.

Eigenvalues$(M1+M2)=1.146,3.869,13.173$

Solution$=(0.739-0.235j,0.483+0.306j,0.246+0.104j)$

One at a Time

We solve just the acoustics problem, then do the rest all at once. That way, the acoustics problem is solved exactly.

$$\text{Eigenvalues}(M1)=0,0,10.714$$

$$V1=(0.770-0.199j,0.376+0.202j,0.377+0.206j)$$

$$V2=(0.097-0.071j,0.765+0.010j,-0.632+0.0016j)$$

As V1 and V2 both correspond to a zero eigenvalue, a.V1+b.V2 is also an eigenvector corresponding to a zero eigenvalue—i.e., it is an exact solution to the acoustics problem.

Form the "all at once" minimisation for the structural problem using a and b.

$$M2' = \begin{pmatrix} 1.314 & -0.381+0.341j \\ -0.381-0.341j & 0.093 \end{pmatrix}; \quad |M2'| = 5.098$$

M1' eigenvalues, 1.222 and 4.172

$$\text{Eigenvector after scaling: } (0.984-0.016j,0.113+0.115j)$$

Now combine V1 and V2 to get the inputs $$(0.984-0.016j)V1+(0.113+0.115j)V2=(0.776-0.207j,0.473+0.283j,0.290-0.124j)$$

$$\text{Normalise and scale the result: } (0.755-0.211j,-0.466+0.270j,0.246+0.104j)$$

Notice that this is similar, but not identical to the "all at once" solution. When extended to cover a range of frequencies, it gives a precise result to the acoustics problem, where numerical rounding causes the very slight non-zero pressure in the sequential case.

As set out above, the two methods are not mutually exclusive, and the parallel method may be adopted at any point in the sequential process, particularly to finish the process. The sequential method is useful where the number of inputs does not exceed the number of outputs, particularly when some of the outputs are more important than others. The important outputs are solved exactly, and those remaining get a best fit solution.

In an arrangement where only maximisation is of interest for the ensemble of outputs, then there is no value in using the "one at a time" algorithm.

Thus, in this way, the signal processor controller 108 of the panel loudspeaker controller 100 may be preconfigured by an electronic device, such as a computer. That is to say, configured at the design stage before it is put in use to improve phase alignment between the signals as an ensemble output at the outputs of the signal processors.

Figure 10:
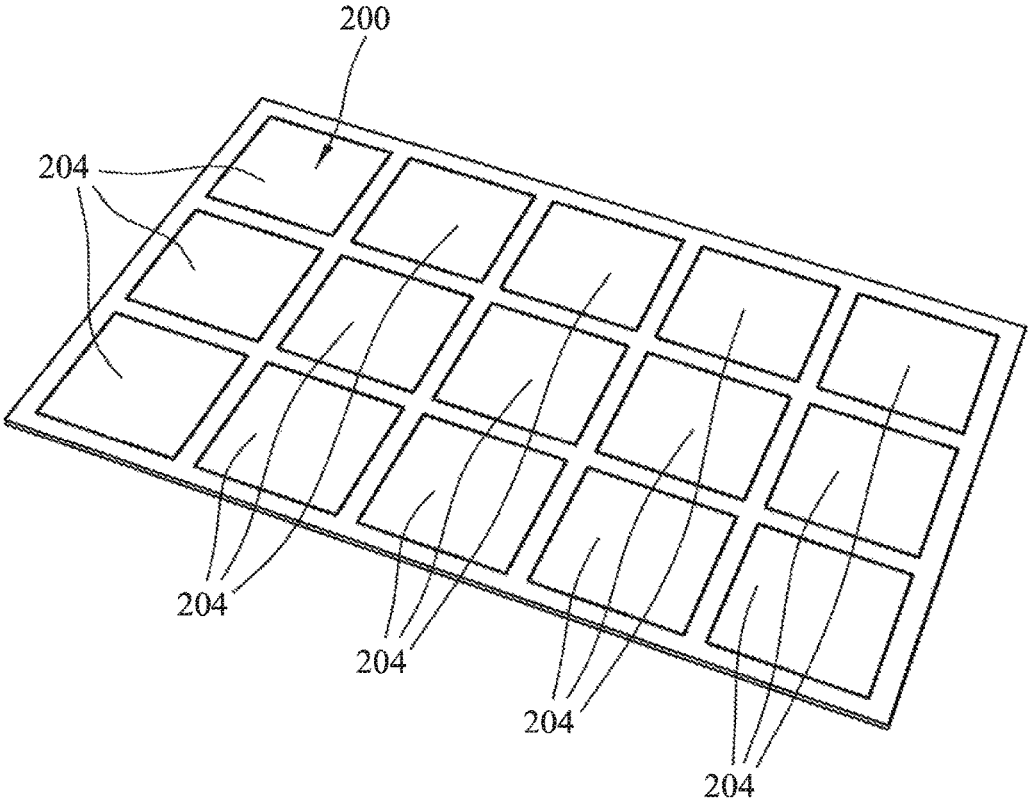
FIG. 10 is a schematic diagram illustrating a portion of another panel loudspeaker according to certain embodiments.

FIG. 10 illustrates an integrated module 200 of piezoelectric elements 204 or, in other words, an array of addressable piezoelectric elements forming an actuator array component, which may form part of a flat panel loudspeaker, in this example, for use in a portable computer, such as a tablet computer or laptop computer (not shown). In the pursuit of making thin portable computers, direct drive using electrically active materials is very attractive.

The module 200 of piezoelectric elements comprises an array of relatively small piezoelectric patches 204 (in this example, 20 mm square) with appropriate connection of electrodes to provide a small number of input channels. The example array of patches of FIG. 10 is arranged into, in this example, 3 rows of 5 columns of patches. The inventors of the present patent application have appreciated that the activation level is directly proportional to the patch area, and, especially at low frequencies, almost independent of the aspect ratio or shape. The activation level is the amount of output or activity caused by the patch area, which, in this example, is acoustic pressure. The area proportionality and shape invariance may be determined by simulation.

Figure 11:
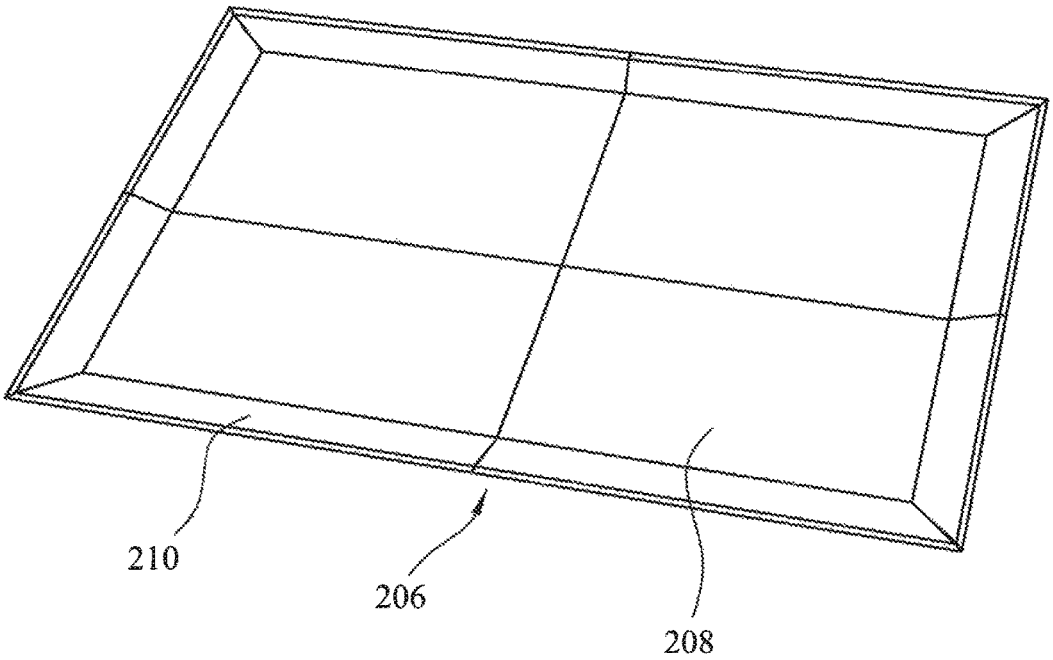
FIG. 11 is a schematic diagram illustrating a back panel of a device incorporating a panel loudspeaker of which a portion is illustrated in FIG. 10.
Figure 12:
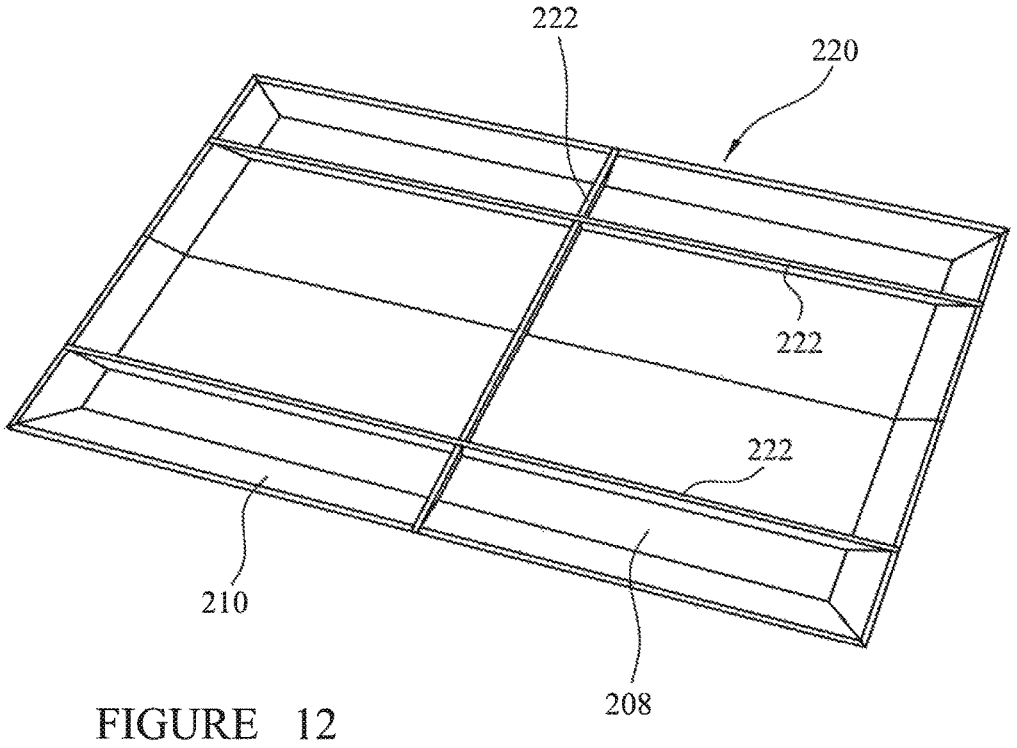
FIG. 12 is a schematic diagram illustrating a back panel of another device incorporating a panel loudspeaker of which a portion is illustrated in FIG. 10.

The module 200 is an audio-only application of direct-drive to the back of the portable computer. In this example, the module is to provide a direct-drive to a display of 12" to 14" (around 300 mm to 350 mm) diagonal length. FIG. 11 illustrates a basic example version of the rear or back panel 206 of the portable device to which the module 200 is applied. It is made from 1 mm thick glass or aluminium. The rear panel has a flat surface 208 of rectangular shape dimensions 280×170 mm, with bevelled edges 210 of 18 mm width. The overall external dimensions are 316×206×5 mm. A variant of the panel of FIG. 11 is illustrated in FIG. 12. The panel 220 of FIG. 12 is similar in appearance in most respects to the panel of FIG. 11 and like features have been given like reference numerals. The panel 220 of FIG. 12 also includes ribs 222 to reinforce glass-filled polymer (PBT-GF30%) of 1 mm thickness of which the panel is made (roughly equivalent in strength to 1.5 mm thick acrylonitrile butadiene styrene plastics (ABS)).

Figure 13:
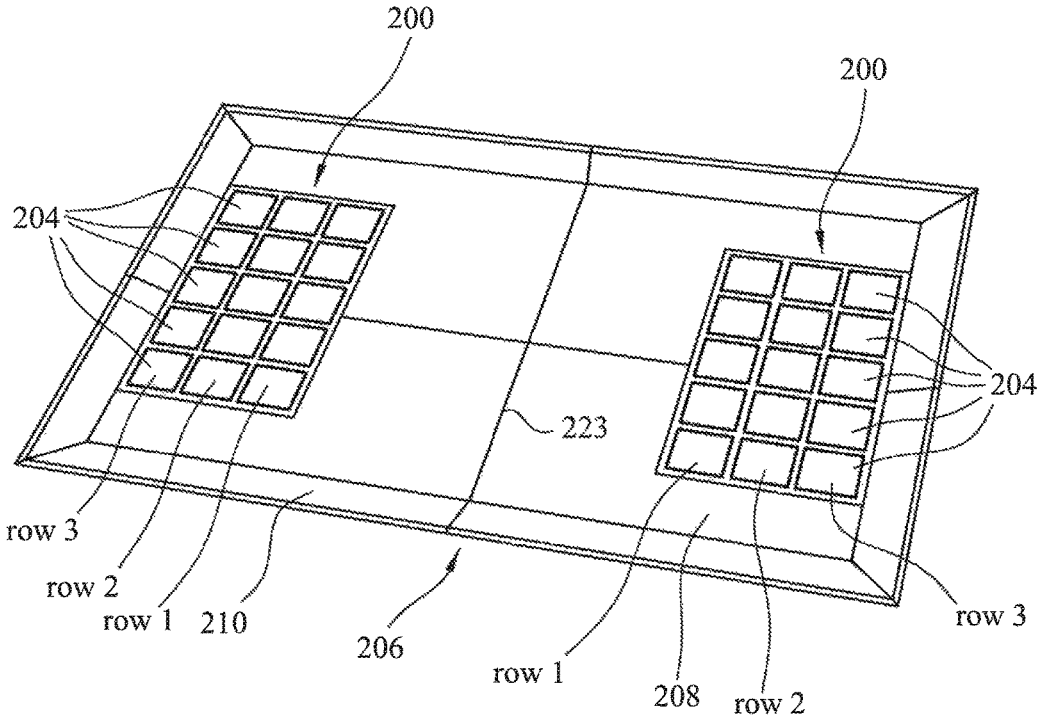
FIG. 13 is a schematic diagram illustrating the back panel of FIG. 11 and a pair of the panel loudspeakers of which a portion is illustrated in FIG. 10.

FIG. 13 illustrates the panel 206 of FIG. 11 including a pair of actuator array components or arrays 200 of FIG. 10 (like features in the figures have been given like reference numerals). The piezoelectric elements 204 of each array are wired to give three channels of five elements each. One of the arrays is located on one side of the panel and the other module is on the other side of the panel. Each array provides a single channel of a stereo loudspeaker system. The two arrays are, in this example, arranged as a mirror image of one another with the mirror line dividing the panel along its length, which, in this example, is a single central rib 223.

A parametrised finite element model of the arrangement of FIG. 13 including the panel 206, two arrays 200 of patches 204 as described above, and external air to a radius of 250 mm was constructed on a computer. The positioning of the arrays of patches and the electrodes to be energised were the two variables considered. From this model, the on-axis pressure (response in air at the selected distance from the arrays of 250 mm) on the driven side and the other (display) side was collected. The difference between the two pressures is almost independent of either variable being considered, or of which version of the two panels describe above are simulated.

Figure 14:
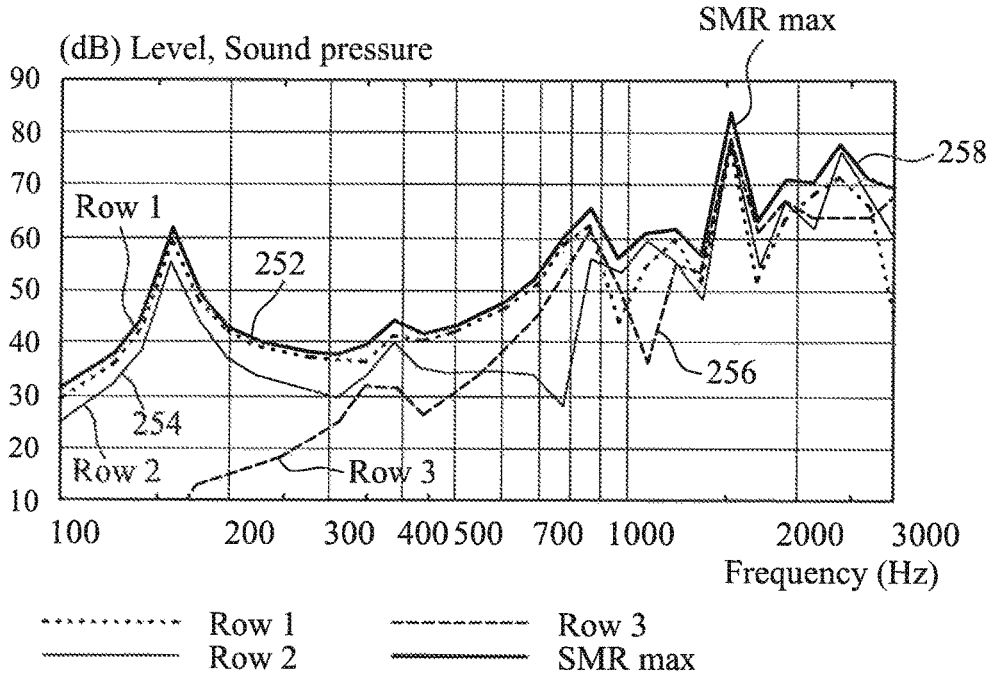
FIG. 14 is a graph of a simulated sound pressure level response against frequency of the combined and individual sources of a panel loudspeaker including the portion illustrated in FIG. 10.
Figure 15:
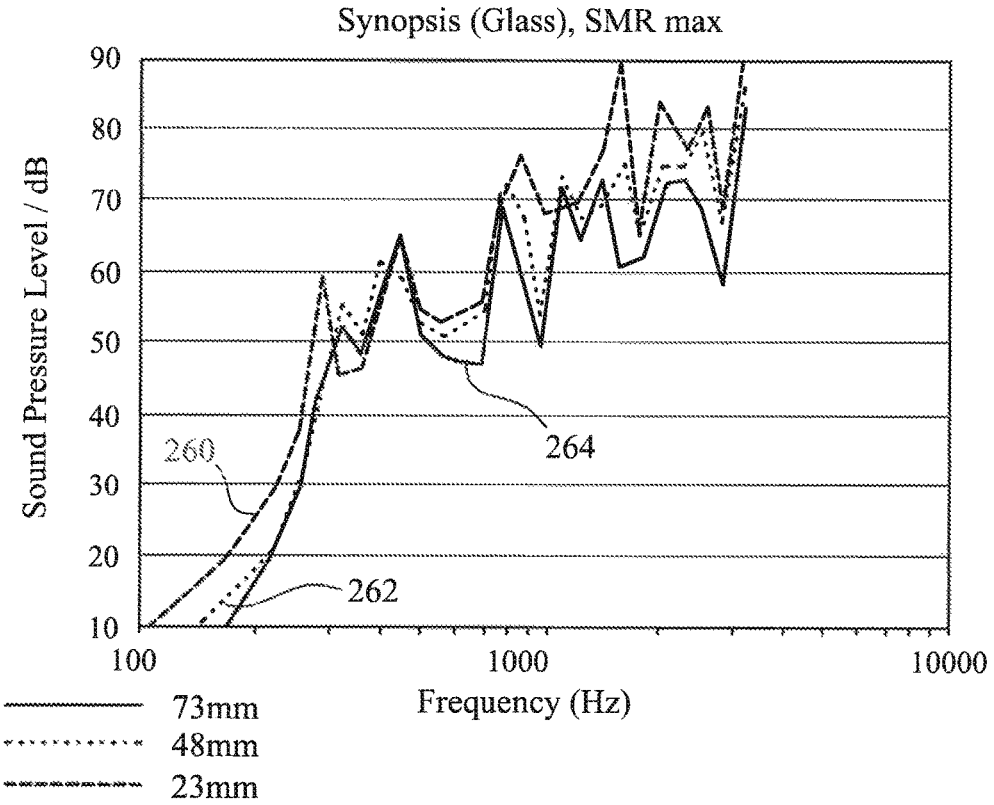
FIG. 15 is a graph of a simulated sound pressure level response against frequency of the device of FIG. 11 at various distances in air from the device.

Electrodes were energised in each row (of five patches) in each array 200 of patches 204 at a time, and symmetrically (both arrays at the same time) (i.e., 5×2 patches=10 patches at a time) (row 1, row 2 and row 3 moving outwardly from the inside as illustrated in FIG. 13), giving three pairs of frequency or impulse responses for each mirrored array location illustrated in FIG. 14. Best responses were obtained by a method described above, which gives the root mean square (rms) average of each of the three responses for a normalised input energy (the SMR max line of FIG. 14). The most sensitive arrangement is with the arrays both close to the middle (row 1), this precludes any stereo separation. As illustrated in FIG. 14, some arrangements result in a row of patches coinciding with a nodal line, making that row largely redundant. An air cavity with a 1 mm gap and total volume of 117.5 $cm^3$ was added to the model and the outcome of this is illustrated in FIG. 15. With this configuration, the lowest (tympanic) mode is shifted upwards in frequency, affecting the bass response of the system. The driven-side sound pressure level (SPL) is illustrated in FIG.

15 at different distances in air from the glass-filled polymer panel 220. The distances are 23 mm (dashed line), 48 mm (dotted line) and 73 mm (solid line).

FIG. 14 illustrates the sound pressure levels against frequency for the three rows of patches 204 individually (row 1, row 2 and row 3 moving outwardly from the inside of the panel 206 (as illustrated in FIG. 13)) and combined using an example method embodying an aspect of the present disclosure. The frequency or impulse response of the individual rows of patches are illustrated in FIG. 14 by lines 252 (row 1), 254 (row 2) and 256 (row 3). The frequency response of the combined patches using an example of the present disclosure is illustrated in FIG. 14 by line SMR max 258 at 250 mm on axis (spaced from the panel) and in FIG. 15 at different distances spaced from the panel by dashed line 260 (23 mm from the panel), dotted line 262 (48 mm from the panel) and solid line 264 (73 mm from the panel). In all cases, the sensitivity is seen to increase substantially from about 700 Hz (especially on the driven side), with some output down to the panel f0. The panel f0 is the lowest acoustically active mode of the panel. It marks the point in the frequency response where there is a marked increase in sensitivity. There may be other lower frequency modes that cause peaks in the acoustic output, but if these are too isolated from the panel f0 (for example, because they come from the actuator rather than the panel), then there is a gap in the response.

In the example of FIGS. 14 and 15, there is evidence of panel modes at about 400 Hz and 800 Hz. The isolated mode is at about 160 Hz in FIG. 14, but at about 280 Hz in FIG. 15. FIG. 14 shows a gap with relatively low acoustic output, whereas FIG. 15 shows the gap filled because the isolated resonance frequency is closer to the panel f0. The region between f0 and 700 Hz is less good, and is particularly weak if f0 is too low.

Figure 16:
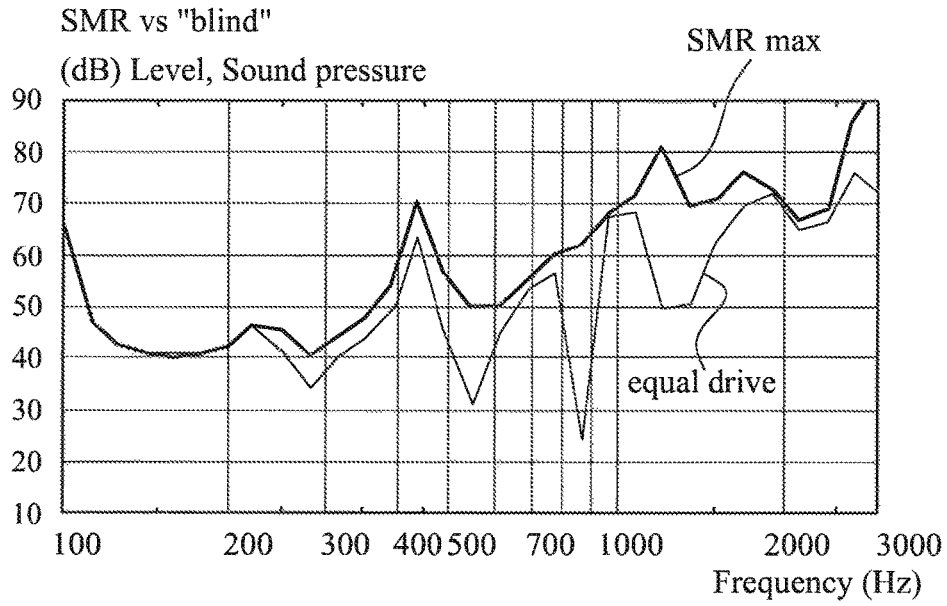
FIG. 16 is a graph of simulated sound pressure level response against frequency of the device of FIG. 11.

As with the electromagnetic example of the arrangement of FIG. 2, the optimal drive potentials need not all be of the same polarity. Hence, driving all of them with the same voltage always results in a lower SPL (assuming the same net input—i.e., all at $1/\sqrt{3}$ volts). Indeed, at some frequencies, the patches effectively cancel each other out as illustrated in FIG. 16 and by the line indicated as "equal drive"). However, as illustrated by the line "SMR max" in FIG. 16, by applying the method of an example of the present disclosure described above it is demonstrated that adequate level and bandwidth of audio may be provided from the rear-panel of a portable computer, such as a tablet or laptop computer of this size. In the method described above, a signal processor controller is associated with all of a plurality of signal processors, each signal processor is associated with each input, each input is associated with each actuator of the panel loudspeaker to be controlled, and each signal processor has an output for an electrical signal to control an actuator of the panel loudspeaker. The signal processor controller is preconfigured to improve phase alignment between the signals as an ensemble output at the outputs of the signal processors.

Activation level for this device is directly proportional to the total patch area. Patch positioning depends on the number and shape of modes being activated, the panel aspect ratio and the number of sources.

As drive potentials need not all be of the same polarity, intelligent use of electrodes is required for best performance. Also, as at frequencies above 1 kHz the performance is much more efficient, the number of patches being driven at these frequencies may be reduced, thereby saving power. Indeed, with other configurations of the design and mounting of the panel, a much smaller number of actuators may be used and still provide adequate performance.

Figure 17:
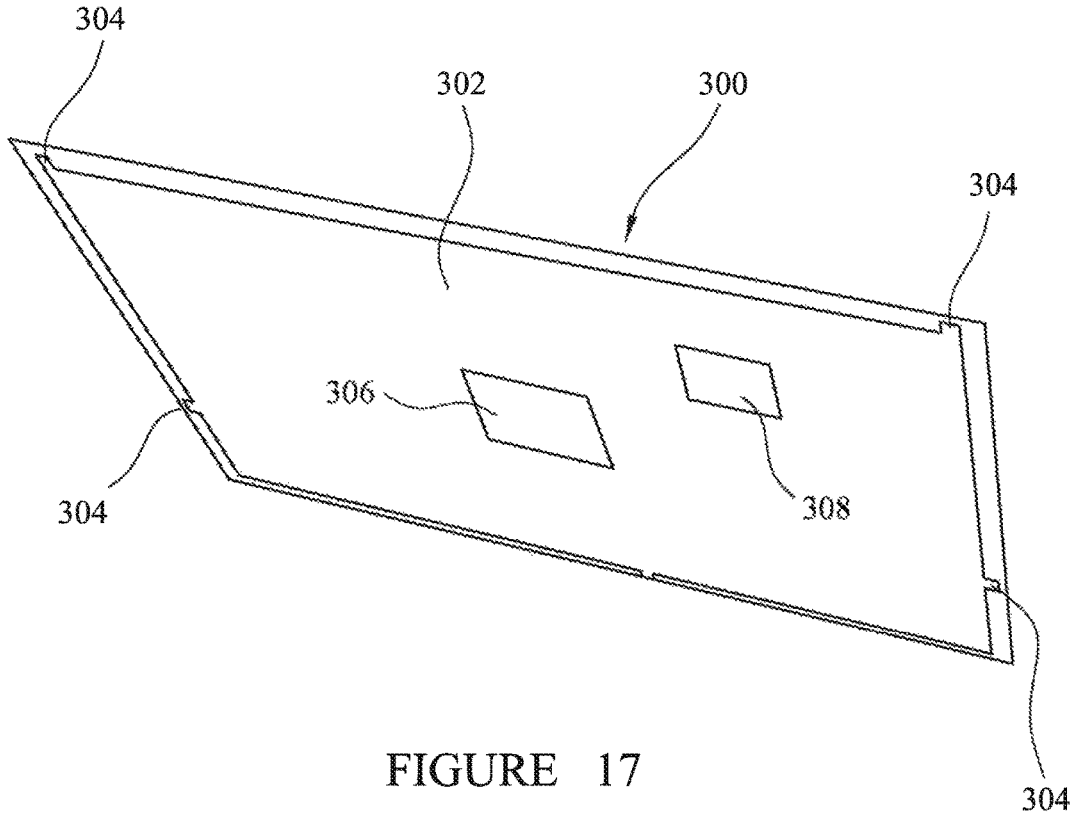
FIG. 17 is a schematic diagram illustrating another panel loudspeaker according to certain embodiments.

FIG. 17 illustrates the use of an example of the use of a rear or back plate 300 of a portable computer or hand-held device such as a tablet computer or an electronic book. The example device is of roughly A5 size and includes a polymer-based optoelectronic display screen such as of organic light emitting diode (OLED) or electrophoretic type (not shown). The device includes a hardened polymer front lens (not shown), display stack (not shown), and a stiffening plate 302. For clarity, the internal air cavities and chassis are also not shown. The display is attached to the rest of the device all around the edge of the polymer lens, and at discrete bolt points on the stiffening plate indicated by small tabs 304 in the illustration of FIG. 17.

Also illustrated in FIG. 17 are two piezoelectric elements or patches 306, 308 of unequal size attached directly to the rear of the stiffening plate 302. The patch 306 near the centre has planar dimensions 50% larger, and hence 2.25 times the area, of the offset patch 308. This means that it also has 2.25 times the capacitance and activity.

The placement and size of this larger patch 306 make it a stronger source, especially at low frequencies, but also means that it draws 2.25 times the current from the supply than the smaller patch 308. It would be better, therefore, from a power consumption point of view, to use the smaller patch where possible, and especially at higher frequencies.

Figure 18:
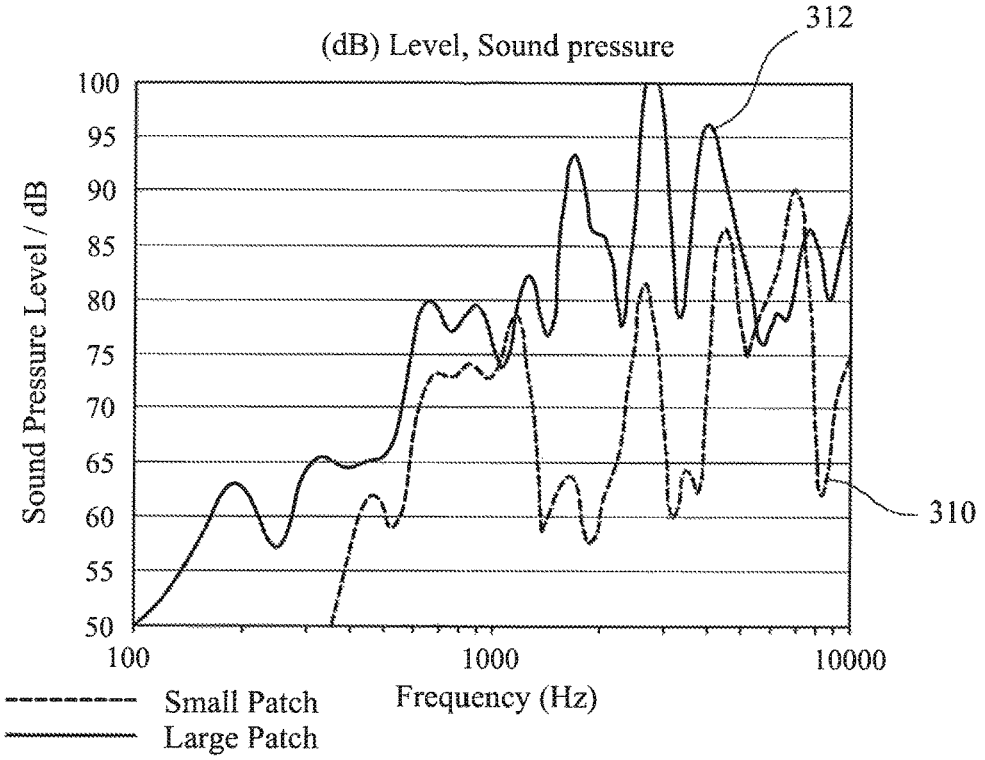
FIG. 18 is a graph of simulated sound pressure level response against frequency of the device of FIG. 17 for two different sizes of patch.

Specimen frequency responses are illustrated in FIG. 18. The frequency response or impulse response of the small patch is illustrated by a dashed line 310 and the frequency response of the large patch is illustrated by a solid line 312. The frequency responses illustrate that from above about 600 Hz, there is plenty of output available to start reducing the electrical input. The lumpiness of the response of the smaller patch is an indication that it is not optimally located.

Combination Strategies

Figure 19:
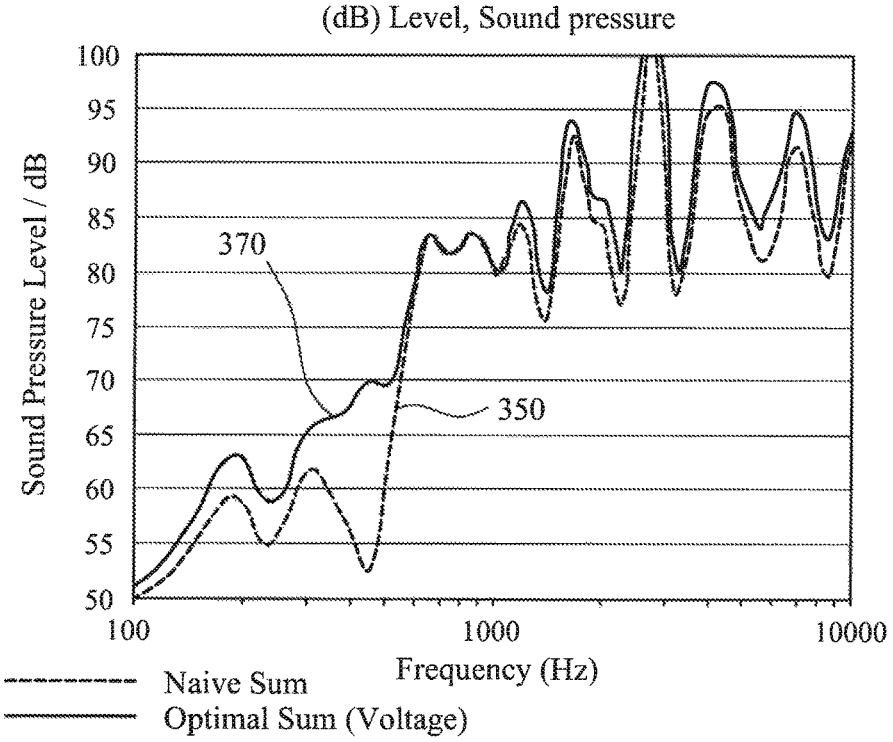
FIG. 19 is a graph of simulated sound pressure level response against frequency of the device of FIG. 17 combined using a naïve summation and a summation using a panel loud speaker controller according to certain embodiments.

Summed frequency or impulse responses from the two patches 306,308 of FIG. 17 are illustrated in FIG. 19.

Figure 20A:
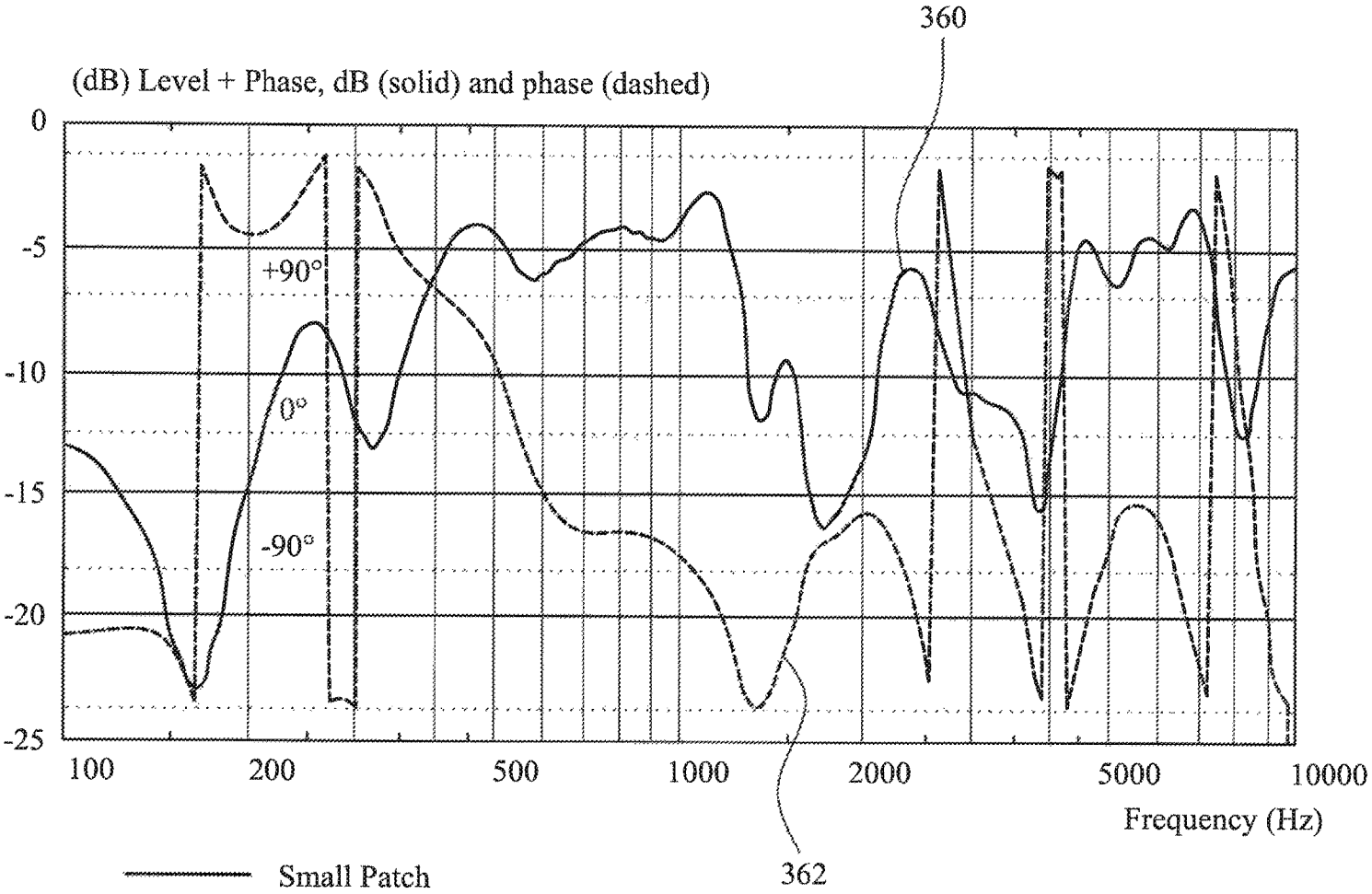
FIGS. 20A and 20B are each a graph of amplitude transfer functions against frequency of the device of FIG. 15 for two different sizes of patch
Figure 20B:
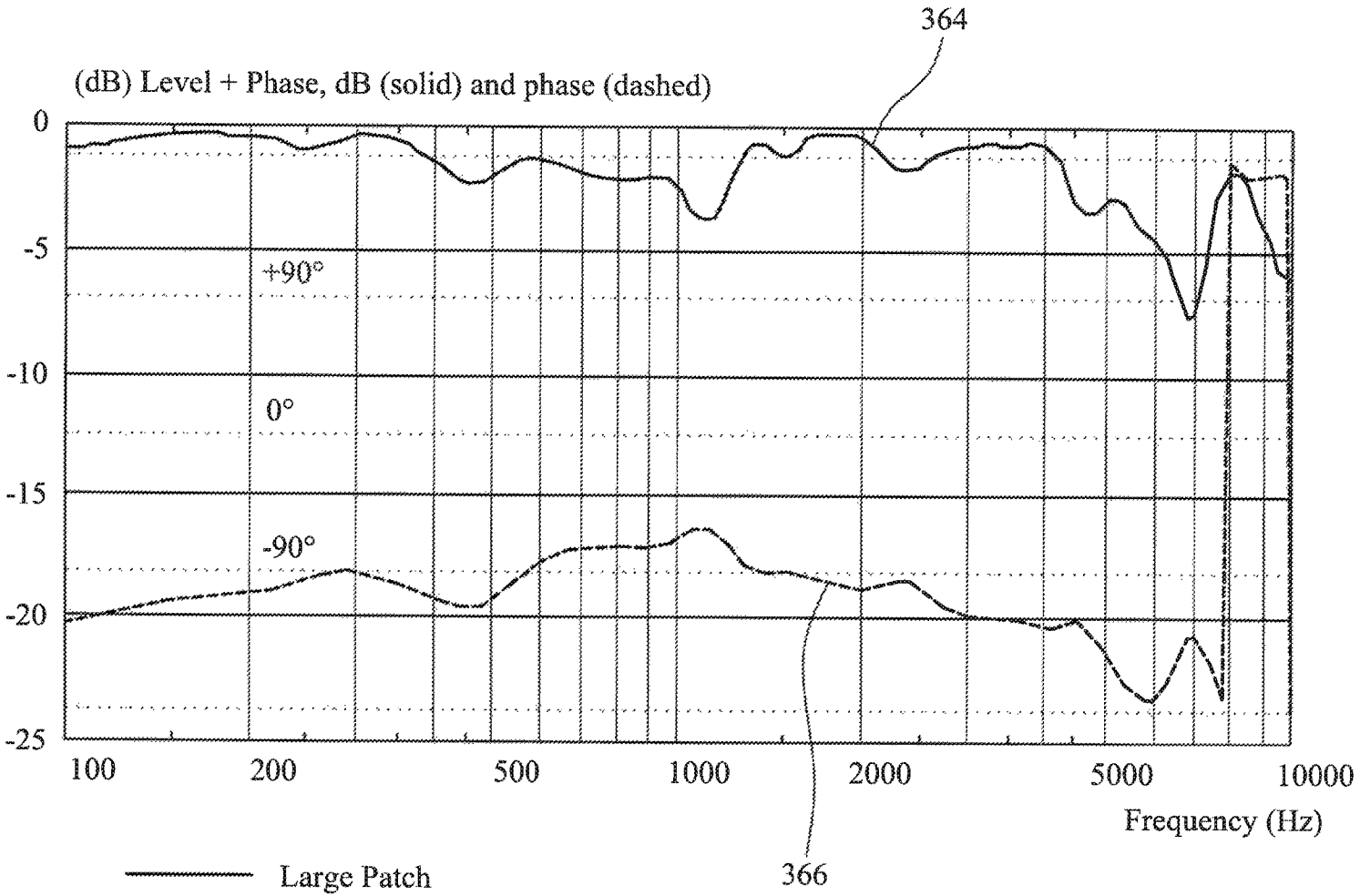

The naïve sum illustrated by a dashed line 350 works reasonably well above 600 Hz, but not below 600 Hz. FIGS. 20A and 20B illustrate the reason for this. FIG. 20A shows the amplitude (solid line, 360) and phase (dashed line, 362) against frequency for the smaller patch 308. FIG. 20B shows the amplitude (solid line, 364) and phase (dashed line, 366) against frequency for the larger patch 306. The key reason for the naïve sum not working well below 600 Hz is that the polarity of the patches needs to be opposite at low frequencies, as can be seen in FIGS. 20A and 20B from the 180° phase difference between the smaller and larger patches at 250 Hz.

Clearly, as shown by the solid line 370 of FIG. 19 and indicated as optimal sum (voltage), the arrangement using an electronic device to preconfigure a panel loudspeaker controller and then to provide a preconfigured panel loudspeaker controller of embodiments of the present disclosure provides a significantly better frequency response at frequencies below 600 Hz.

In practice, it is not necessary to implement the full-bandwidth transfer functions illustrated here. A reasonable approximation is to use simple filtering techniques to do better than the naïve summation. For example, a combination of all-pass and high-pass filters may provide the low-frequency response for the smaller patch. In other words, the signal processor controller may comprise or consist of a filter to be preconfigured to improve phase alignment between output signals as an ensemble.

Normalisation Strategies

In the panel loudspeaker arrangement 300 of FIG. 17, normalisation strategies may be employed to reduce or minimise energy requirements as explained below.

The type of actuators or patches 306,308 of FIG. 17 act as a capacitive load. The energy stored on such capacitive loads, C, at DC voltage V is $$\frac{CV^2}{2}.$$

However, me losses in me circuit are more likely to be due to currents flowing in and out, which are given by $$I = \frac{CV}{2\pi f}$$

where f is frequency. Losses are proportional to $I^2$. So-called reactive power flow is given by IV.

We may normalise out input sensitivities to minimise any one of these energy measures.

$\Sigma V^2=1$, as above, the optimisation assumes equivalent voltage inputs.

$\Sigma VI=1$, the optimisation assumes equivalent energy inputs.

$\Sigma I^2=1$, the optimisation assumes equivalent current inputs.

Thus, for low energy consumption, a panel loudspeaker controller of the panel loudspeaker 300 of FIG. 17, may be preconfigured to increasingly shift the balance of signal amplitude contribution from the larger patch 306 towards the smaller patch 308, as the smaller patch will draw less current.

Embodiments of the present disclosure have been described. It will be appreciated that variations and modifications may be made to the described embodiments within the scope of the present disclosure.

The invention claimed is:

1. A panel loudspeaker controller for controlling a panel loudspeaker comprising a plurality of actuators attached to a panel, the panel loudspeaker controller comprising:

a plurality of electrical signal inputs, each input being associated with each actuator of the panel loudspeaker to be controlled;

a plurality of signal processors, each signal processor being associated with each input and having an output for an electrical signal to control an actuator of the panel loudspeaker, and each signal processor implementing a transfer function from its input to its output based on each actuator of the panel loudspeaker to a desired acoustic receiver; and a signal processor controller associated with all of the plurality of signal processors, wherein the signal processor controller is preconfigured to improve phase alignment between the signals as an ensemble output at the outputs of the signal processors to reduce cancellation of a contribution to an acoustic output of the panel of one actuator by another.

2. The panel loudspeaker controller of claim 1, wherein the signal processor controller comprises a filter in order to be preconfigured to improve phase alignment between the signals as an ensemble output at the outputs of the signal processors.

3. The panel loudspeaker controller of claim 2, wherein the filter comprises a low pass filter and/or an all-pass filter.

4. The panel loudspeaker controller of claim 3, wherein the low pass filter passes signals with a frequency lower than a cut-off frequency of 500 Hz.

5. The panel loudspeaker controller of claim 1, wherein each signal processor comprises a digital signal processor.

6. The panel loudspeaker controller of claim 1, wherein the signal processor controller comprises a digital signal processor in order to be preconfigured to improve phase alignment between the signals as an ensemble output at the outputs of the signal processors.

7. The panel loudspeaker controller of claim 1, wherein signal processing is applied by the signal processor controller to the electrical signal inputs to achieve a maximum or near maximum total ensemble output at the outputs at all frequencies.

8. The panel loudspeaker controller of claim 1, wherein signal processing is applied by the signal processor controller to the electrical signal inputs to achieve a minimum or near minimum acoustic pressure at one or more predetermined spatial locations.

9. The panel loudspeaker controller of claim 1, wherein the signal processor controller comprises an equaliser in order to be preconfigured to improve phase alignment between the signals as an ensemble output at the outputs of the signal processors wherein the equaliser equalises the input signals.

10. The panel loudspeaker controller of claim 1, wherein the plurality of actuators comprise at least one piezoelectric actuator, such as a piezoelectric patch and/or at least one coil and magnet-type actuator and/or a distributed mode actuator.

11. The panel loudspeaker controller of claim 1, wherein the plurality of actuators comprise an array of actuators.

12. The panel loudspeaker controller of claim 1, wherein the acoustic receiver comprises an ear of a user or a microphone.

13. An electronic device configured to configure a signal processor controller of a panel loudspeaker comprising a plurality of actuators, the electronic device being configured to:

input electrical signals into a plurality of electrical signal inputs, each input being associated with each actuator of the panel loudspeaker to be controlled;

measure a response of the panel loudspeaker to the electrical inputs as an ensemble; and use the response to configure a signal processor controller, associated with all of a plurality of signal processors, to improve phase alignment, in use, between signals output at the outputs of the plurality of signal processors as an ensemble, wherein each signal processor is associated with each input and has an output for an electrical signal to control an actuator of the panel loudspeaker, and each signal processor implements a transfer function from its input to its output based on each actuator of the panel loudspeaker to a desired acoustic receiver.

14. The electronic device of claim 13, wherein the input electrical signals, actuators, panel loudspeaker and response are implemented virtually.

15. The electronic device of claim 13, wherein the input electrical signals take the form of an impulse and the response takes the form of an impulse response.

16. The electronic device of claim 13, wherein the electronic device is configured to use the response to configure the signal processor controller by assessing differences between transfer functions of the signal processors.

17. A method of configuring a signal processor controller of a panel loudspeaker comprising a plurality of actuators, the method comprising:

inputting electrical signals into a plurality of electrical signal inputs, each input being associated with each actuator of the panel loudspeaker to be controlled;

measuring a response of the panel loudspeaker to the electrical inputs as an ensemble; and using the response to configure a signal processor controller, associated with all of a plurality of signal processors, to improve phase alignment, in use, between signals output at the outputs of the plurality of signal processors as an ensemble, wherein each signal processor is associated with each input and has an output for an electrical signal to control an actuator of the panel loudspeaker, and each signal processor implements a transfer function from its input to its output based on each actuator of the panel loudspeaker to a desired acoustic receiver.

18. The method of claim 17, wherein the input electrical signals take the form of an impulse and the response takes the form of an impulse response.

19. The method of claim 17, wherein using the response to configure the signal processor controller comprises assessing differences between transfer functions of the signal processors.

* * * * *